US006158179A

United States Patent [19]

Ackerly et al.

[11] Patent Number: 6,158,179

[45] Date of Patent: Dec. 12, 2000

[54] OVERHEAD STRUCTURES FOR WALL SYSTEM

[75] Inventors: Anne C. Ackerly, Stow, Mass.; David J. Battey, Kentwood; David P. Churchill, Kalamazoo, both of Mich.; James H. Davies, Toronto, Canada; Gregg R. Draudt, Stow, Mass.; Michael D. Elsholz, Grand Rapids, Mich.; Roy W. Fink, Portage, Mich.; Steven F. Goodman, Wyoming, Mich.; Steven C. Gortsema, Grandville, Mich.; Peter C. Greenberg, Somerville, Mass.; Allen C. Hager, Grand Rapids, Mich.; Harold Halvorson, Jr., Grand Rapids, Mich.; James D. Houda, Grand Rapids, Mich.; Robert E. Jeffers, Ada, Mich.; Gary S. Juhlin, Caledonia, Mich.; Robert J. Luchetti, Cambridge, Mass.; Karl J. Mead, Grand Rapids, Mich.; Scott H. Russell, Kalamazoo, Mich.; Peter J. Schauer, Scarborough, Canada; David A. Shipman, Grand Rapids; Anthony A. Stachowiak, Belmont, both of Mich.; Michael Tingley, Portland, Oreg.; Genevieve Wing, Grand Rapids, Mich.

[73] Assignee: Steelcase Development Inc., Grand Rapids, Mich.

[21] Appl. No.: 09/038,370

[22] Filed: Mar. 10, 1998

[51] Int. Cl.[7] ..... E04B 2/00

[52] U.S. Cl. ..... 52/220.7; 52/36.4; 52/36.5; 52/204.1; 52/238.1; 52/243; 52/126.3

[58] Field of Search ..... 52/36.1, 36.4, 52/36.5, 204.1, 220.2, 220.7, 238.1, 242, 243, 126.3, 731.1, 731.5, 731.9

[56] References Cited

U.S. PATENT DOCUMENTS

| | | | |
|---|---|---|---|
| 1,575,705 | 3/1926 | Oberdorfer et al. | 52/238.1 |
| 1,716,624 | 6/1929 | Dawson . | |
| 1,724,821 | 8/1929 | Bohnsack | 52/238.1 |
| 2,020,502 | 11/1935 | Godard | 52/238.1 |
| 2,078,491 | 4/1937 | Graham . | |
| 2,097,484 | 11/1937 | Winslow | 52/220.7 |
| 2,121,213 | 6/1938 | Small . | |
| 2,159,296 | 5/1939 | Sharp | 52/220.7 X |
| 2,304,423 | 12/1942 | Schiller . | |
| 2,315,687 | 4/1943 | Burke . | |
| 2,558,428 | 6/1951 | Fuller et al. . | |
| 2,621,763 | 12/1952 | Buquor et al. . | |
| 2,766,855 | 10/1956 | Johnson . | |
| 3,066,770 | 12/1962 | Millard . | |

(List continued on next page.)

FOREIGN PATENT DOCUMENTS

| | | |
|---|---|---|
| 581818 | 12/1987 | Australia . |
| 1188259 | 3/1965 | Germany . |

*Primary Examiner*—Robert Canfield
*Attorney, Agent, or Firm*—Price Heneveld Cooper DeWitt & Litton

[57] ABSTRACT

A wall structure for dividing building space includes several different freestanding base panels such as an internally open partition panel, a sound-deadening partition panel, a glass-supporting partition panel, and a doorway-supporting partition panel, and further includes an overhead system comprising a structural expressway construction, a transom subframe, covers for the subframe, and a glass module attachable to the subframe. The structural expressway construction has a torque box bracket for moving support from an inboard location spaced from the vertical side edge of the base panels to the vertical side edge. The transom subframe mounts atop the different base panels, and telescopingly extends into mating engagement with a ceiling channel. The opening between the ceiling channel, the top of the structural expressway construction, and the transom subframes can be selectively covered with either covers or a window subassembly that releasably engages structure on the ceiling channel, the structural expressway construction and the subframes.

45 Claims, 25 Drawing Sheets

U.S. PATENT DOCUMENTS

| | | | |
|---|---|---|---|
| 3,101,817 | 8/1963 | Radek . | |
| 3,173,179 | 3/1965 | Edwards | 52/213 X |
| 3,423,897 | 1/1969 | Birum . | |
| 3,557,499 | 1/1971 | Dickie . | |
| 3,568,383 | 3/1971 | Judkins et al. | 52/242 X |
| 3,691,709 | 9/1972 | Ostborg | 52/238.1 |
| 3,749,432 | 7/1973 | Janssen | 52/238.1 X |
| 3,757,485 | 9/1973 | Vincens | 52/238.1 X |
| 3,774,360 | 11/1973 | Hubbard . | |
| 4,037,379 | 7/1977 | Ozanne . | |
| 4,103,463 | 8/1978 | Dixon . | |
| 4,129,163 | 12/1978 | Johnson . | |
| 4,224,769 | 9/1980 | Ball et al. | 52/238.1 X |
| 4,277,920 | 7/1981 | Dixon . | |
| 4,361,994 | 12/1982 | Carver . | |
| 4,391,073 | 7/1983 | Mollenkopf et al. | 52/220.7 X |
| 4,450,658 | 5/1984 | Legeai | 52/126.3 |
| 4,454,690 | 6/1984 | Dixon . | |
| 4,470,232 | 9/1984 | Condevaux et al. | 52/220.7 |
| 4,535,577 | 8/1985 | Tenser . | |
| 4,567,698 | 2/1986 | Morrison . | |
| 4,685,255 | 8/1987 | Kelley . | |
| 4,709,517 | 12/1987 | Mitchell . | |
| 4,716,699 | 1/1988 | Crossman . | |
| 4,730,740 | 3/1988 | Winter . | |
| 4,800,696 | 1/1989 | Miller . | |
| 4,815,246 | 3/1989 | Haas . | |
| 4,876,835 | 10/1989 | Kelley . | |
| 4,897,975 | 2/1990 | Artwick . | |
| 4,905,428 | 3/1990 | Sykes . | |
| 4,918,886 | 4/1990 | Benoit . | |
| 5,025,603 | 6/1991 | Johnson . | |
| 5,038,534 | 8/1991 | Pollock . | |
| 5,038,539 | 8/1991 | Kelley . | |
| 5,062,246 | 11/1991 | Sykes . | |
| 5,065,556 | 11/1991 | DeLong . | |
| 5,079,884 | 1/1992 | Menchetti . | |
| 5,086,597 | 2/1992 | Kelley . | |
| 5,142,832 | 9/1992 | Branham . | |
| 5,146,723 | 9/1992 | Greenwood . | |
| 5,152,698 | 10/1992 | Juhlin . | |
| 5,174,086 | 12/1992 | Payne . | |
| 5,175,969 | 1/1993 | Knauf . | |
| 5,184,441 | 2/1993 | Balfanz . | |
| 5,187,908 | 2/1993 | Losensky . | |
| 5,207,037 | 5/1993 | Giles et al. | 52/126.6 |
| 5,228,254 | 7/1993 | Honeycutt | 52/241 |
| 5,241,796 | 9/1993 | Hellwig . | |
| 5,255,478 | 10/1993 | Baranowski . | |
| 5,277,007 | 1/1994 | Hellwig . | |
| 5,309,686 | 5/1994 | Underwood . | |
| 5,341,615 | 8/1994 | Hodges . | |
| 5,383,318 | 1/1995 | Kelley . | |
| 5,394,658 | 3/1995 | Schreiner et al. | 52/36.1 |
| 5,406,760 | 4/1995 | Edwards . | |
| 5,433,046 | 7/1995 | MacQuarrie . | |
| 5,471,805 | 12/1995 | Becker . | |
| 5,490,357 | 2/1996 | Lin . | |
| 5,546,718 | 8/1996 | Way | 52/238.1 |
| 5,560,149 | 10/1996 | Lafevre . | |
| 5,638,650 | 6/1997 | Edwards | 52/220.7 X |
| 5,657,601 | 8/1997 | Bean et al. . | |
| 5,675,946 | 10/1997 | Verbeek et al. | 52/36.1 |
| 5,743,054 | 4/1998 | Luchetti et al. | 52/238.1 X |
| 5,746,034 | 5/1998 | Lucheti et al. | 52/36.1 X |
| 5,746,035 | 5/1998 | Seiber et al. | 52/238.1 |
| 5,806,258 | 9/1998 | Miedema et al. | 52/36.1 X |
| 5,809,708 | 9/1998 | Greer et al. | 52/220.7 |
| 5,813,178 | 9/1998 | Edwards | 52/220.7 X |
| 5,816,001 | 10/1998 | Goodman et al. | 52/220.7 X |
| 5,839,240 | 11/1998 | Elsholz et al. | 52/220.7 X |
| 5,852,907 | 12/1998 | Yu et al. | 52/220.7 |
| 5,855,100 | 1/1999 | Hsuch . | |
| 5,899,025 | 5/1999 | Casey et al. | 52/220.7 X |
| 5,899,036 | 5/1999 | Seiber et al. | 52/243 X |
| 5,943,834 | 8/1999 | Jeffers et al. | 52/220.7 X |

Fig. 14
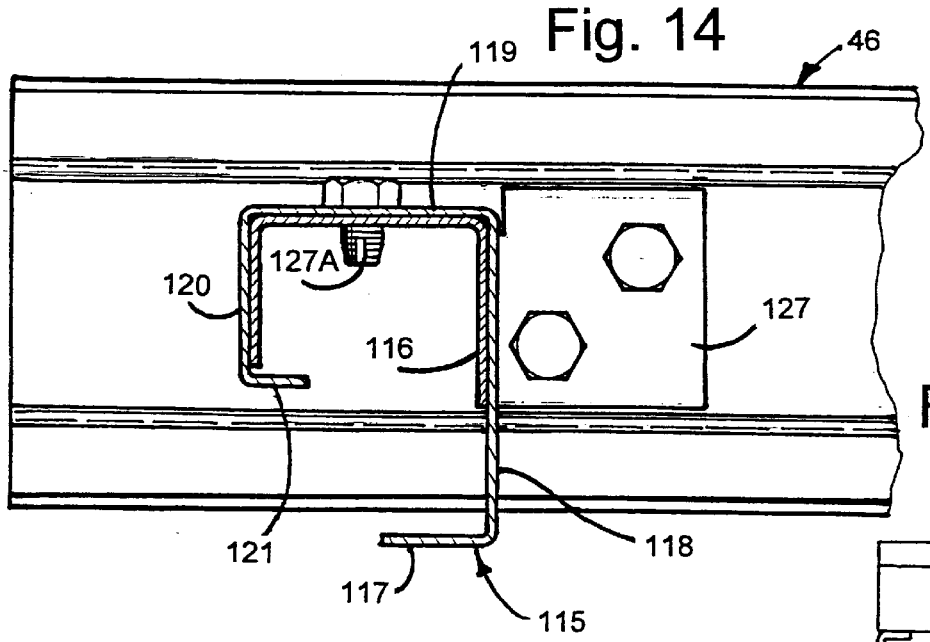
Fig. 14A
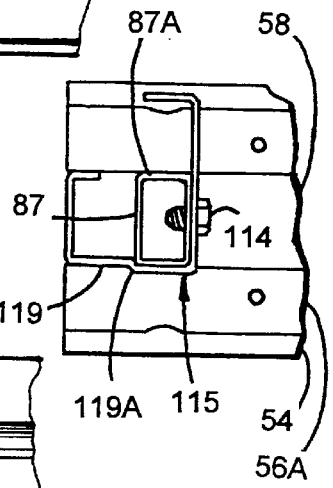
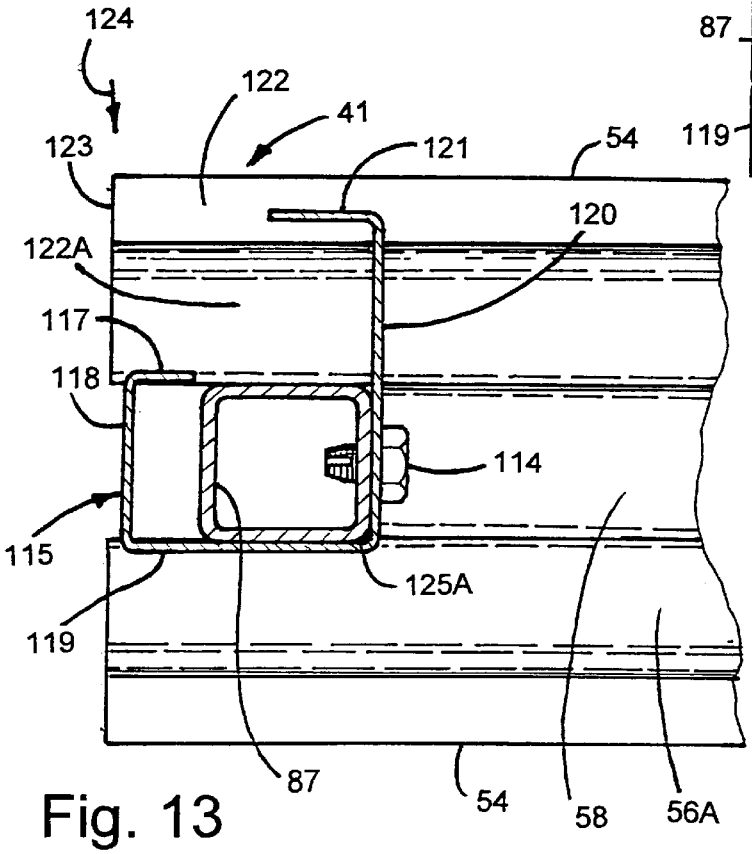
Fig. 13

Fig. 21A
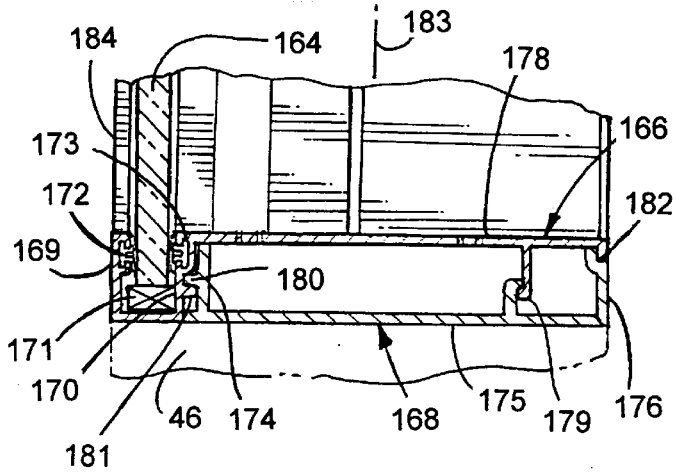
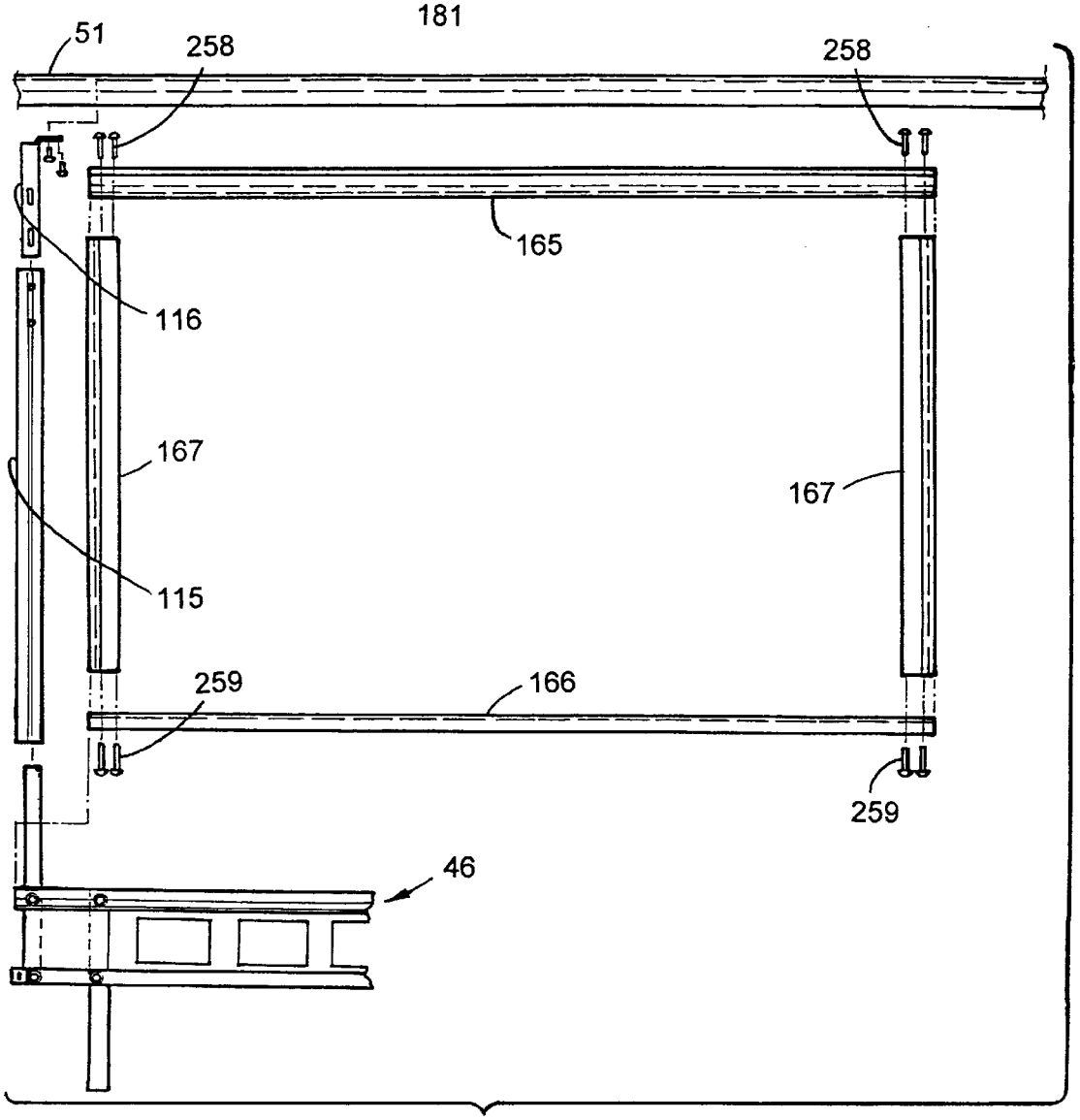
Fig. 20

OVERHEAD STRUCTURES FOR WALL SYSTEM

RELATED APPLICATIONS

The present application is related to the following copending, coassigned patent applications:

| Appln. No. | Filing Date | Title |
|---|---|---|
| 09/038371 | March 10, 1998 | WALL PANEL PARTITION SYSTEM |
| 09/037840 | March 10, 1998 | VARIABLE WIDTH END PANEL |
| 09/037476 | March 10, 1998 | CLEAR WALL PANEL SYSTEM |
| 08/367804 | December 30, 1994 | INTEGRATED REFABRICATED FURNITURE SYSTEM FOR FITTING-OUT OPEN PLAN BUILDING SPACE |
| 08/579614 | December 26, 1995 | PARTITION SYSTEM |
| 08/767817 | December 17, 1996 | PARTITION CONSTRUCTION INCLUDING REMOVABLE COVER PANELS |

BACKGROUND

The present invention relates to reconfigurable wall systems for flexibly subdividing a building space, and more particularly relates to a wall system that includes different base partitions and an overhead system extending above the base partitions to a building ceiling, where the overhead system is reconfigurable, is constructed to manage wires and cables routed above the base partitions, and is constructed to selectively cover the overhead space above the base partition up to the building ceiling with covers or a window system, both of which accommodate different ceiling heights.

It is important that wall systems for subdividing building space be constructed to meet the ever changing needs of businesses. Many manufacturers offer partitions that divide floor space from a building floor to about 84-inches high. However, an important aspect of space division occurs in the overhead space above 84 inches up to a ceiling, since covering this overhead area can greatly affect visual, physical, and acoustical privacy, as well as affect the level of ambient light, the attractiveness and aesthetic appearance of the overall system, the reconfigurability and rearrangeability of the wall system, the overall functionality of the wall system, and the cost of the wall system. In particular, improvements are desired in overhead systems so that decorative covers and windows can be selectively attached in the overhead space, where the overhead systems use common components that flexibly accommodate various ceiling heights, but that also provide complete covering of the overhead space with components that look good and are securely held in place. Further, improvements are desired to allow the overhead system to be reconfigured and rearranged as its underlying base wall system is reconfigured and rearranged, but that also allow this reconfiguration and rearrangement to be done using mostly existing components, even where the ceiling height is not the same throughout the area being subdivided.

Modern wall systems must be adapted to carry a high density of wiring and cables, because of the intense use of computers, telephones, and other electrical devices, and their interconnection. The overhead space in walls is an advantageous area to carry wires and cables because overhead areas on walls usually do not become blocked or encumbered by furniture and other items placed against them, such that they remain accessible for addition of more wires and cables as desired. However, modern wall systems preferably are also adapted to support work tool accessories, such as marker boards, lighting, and the like, having specialized functions that help workers do their jobs. Accordingly, improvements are desired in overhead systems that allow wires and cables to be flexibly routed therethrough, but that do so in a manner that does not sacrifice the structural integrity of the wall system and its ability to support work tool accessories or its appearance.

Many wall systems have specialized partition sections with particular functional properties, such as sound absorption, fire resistance, light transmission, and appearance. It is important that the overhead system be attachable to any of the different specialized partition sections, and at the same time be consistent with the specialized function so that it supplements the specialized function without detracting from the wall's appearance.

Accordingly, a wall system is desired solving the aforementioned problems and that satisfies the aforementioned needs.

SUMMARY OF THE PRESENT INVENTION

In one aspect of the present invention, a structural wireway construction is adapted for attachment atop a base partition panel and adapted to support a transom structure that extends thereabove, the base partition panel including vertical side edges. The structural wireway construction includes a pair of outwardly facing, elongated wireway troughs, and a torque box bracket attached between the wireway troughs near an end of the wireway troughs for providing torsional strength at the end of the wireway troughs. The torque box bracket and wireway troughs defining a pocket located near but inboard of the end of the wireway troughs. The wireway troughs and the torque box bracket form a structural unit capable of supporting loads thereabove. At least one elongated edge connector has a lower end section extending into the pocket and is connected to one of the torque box bracket and the troughs, and has an upper end section that extends upwardly and that is adapted for connection to the transom structure. The edge connector is located at the end of the wireway troughs and is configured to structurally support the transom structure at the one vertical side edge.

In another aspect of the present invention, a wall system for subdividing a building space including a floor and a ceiling includes a base partition panel having a frame, a ceiling channel configured for attachment to the ceiling and having a down flange, and an adjustably extendable transom subframe having a bottom end attached to the partition frame and a top end attached to the ceiling channel, one of the transom subframe and the partition frame including an upwardly extending flange proximate a face of the base partition panel near a top edge of the frame. A transom cover is provided that is shaped to cover a space between the top edge of the partition frame and the ceiling, the transom cover including a hooked lower connector for engaging the upwardly extending flange, and including an upper edge with an upper connector configured to engage the down flange on the ceiling channel.

In another aspect of the present invention, a wall system for subdividing a building space including a floor and a ceiling includes a base partition panel having a frame including a frame member defining a top surface, a ceiling channel configured for attachment to the ceiling, and an adjustably extendable transom subframe having a bottom end attached to the frame member and a top end attached to the ceiling channel. A window construction is provided that is shaped to fit within a space between a top edge of the frame and the ceiling, the window construction including a window frame with a lower section configured to mateably engage the top surface, side sections shaped to mateably slidably engage the subframe from a face of the wall system, and a top section shaped to matingly engage the ceiling channel.

In yet another aspect of the present invention, a method of closing an overhead space between a partition system and a ceiling includes providing a base partition panel having vertical side edges and a top edge, and attaching a pair of adjustably extendable transom subframes to the top edge at each of the vertical side edges and to a ceiling channel, the subframes combining with the base partition panel and the ceiling channel to define an overhead space. The method further includes providing a transom cover shaped to cover the overhead space and including connectors configured for attachment to the ceiling channel and the base partition panel, providing a window assembly shaped to cover the overhead space, the window assembly including a window frame shaped to mateably engage the subframes, the ceiling channel, and the top edge of the base partition panel, and selecting and then securing one of the transom cover and the window assembly in the overhead space.

In another aspect of the present invention, a kit for closing an overhead space between a wall panel system and a ceiling includes a base partition panel having vertical side edges and a top edge, a ceiling channel configured for attachment to a ceiling, and a pair of extendable transom subframes having a bottom end configured to attach to the top edge at each of the vertical side edges and a top end configured to attach to a ceiling channel, the subframes when attached to the base panel and the ceiling channel defining an overhead space. A transom cover is provided that is shaped to cover the overhead space, the transom cover including connectors configured for attachment to at least one of the subframes, the ceiling channel, and the base panel. A window assembly is also provided that is shaped to cover the overhead space, the window assembly including a window frame shaped to mateably engage the subframes, the ceiling channel, and the base panel, whereby the transom cover and the window assembly can be selectively used to cover the overhead space.

In another aspect of the present invention, a wall system for subdividing a building space includes a partition panel having a rigid frame defining vertical side edges and a top edge section, the rigid frame including an upright, and a pair of outwardly facing, elongated wireway troughs attached to the upright and that define horizontal raceways along the top edge section, the wireway troughs being constructed to bear weight and to support work tool accessories. A bracket is provided that has attachment flanges shaped for connection to one of the wireway troughs and also has a body spaced laterally from the attachment flange and configured to support an accessory on the one wireway trough.

In another aspect of the present invention, a wall system for subdividing a building space includes a wall partition panel having vertical side edges and a top edge, the wall partition panel including a frame with uprights located near the vertical side edges and including a pair of elongated vertically extending connectors attached to the uprights along the vertical side edges, the vertically extending connectors including an upper end extending above the top edge, the wall partition panel having front and rear faces that define a vertical/longitudinal central plane therebetween. A pair of telescopically adjustable transom subframes each include a lower elongated frame member attached to the upper end of an associated one of the vertically extending connectors, and an upper telescopingly adjustable frame member with a flange adapted for connection to a ceiling channel, the lower elongated frame member having flanges defining a non-uniform cross section relative to the vertical/longitudinal central plane.

In yet another aspect of the present invention, a wall system for subdividing a building space includes a base partition panel, a ceiling channel, an extendable transom frame configured for attachment between the base partition panel and the ceiling channel, and a transom cover having a top edge section made of a material that can be readily cut at a job site. A removable top connector attached to the top edge section and configured to be removed and later reattached to the transom cover after cutting off part of the top edge section of the transom cover, the top connector being configured to securely engage one of the ceiling channel and the extendable transom frame to retain the transom cover in a position to cover the transom frame, whereby the transom cover can be cut to a desired size on the job site.

In another aspect of the present invention, a wall system for subdividing a building space includes a plurality of different base partition panels interconnected to form office areas, each of the different base partition panels having top edge sections and opposing vertical side edges. The different base partition panels include an internally open partition panel adapted for flexibly carrying utilities, a sound-absorbing partition panel, and a glass-supporting partition panel. Each one of the different partition panels has an elevated wireway defined along their respective top edge sections. The plurality of different partition panels each are positioned to align the elevated wireways and are interconnected to define office areas.

In another aspect of the present invention, a wall system for subdividing a building space having a ceiling includes a plurality of different base partition panels interconnected to form office areas. Each of the different base partition panels has a top surface. The different base partition panels include an internally open partition panel adapted for flexibly carrying utilities, a sound-absorbing partition panel, and a glass-supporting partition panel. A transom system includes a plurality of vertically extending, similarly shaped transom frames, at least one of the transom frames being attached to each of the different base partition panels and extending from the top surface of the associated different base partition panels to the ceiling.

These and other features, advantages and objects of the present invention will be further understood and appreciated by those skilled in the art by reference to the following written specification, claims, and appended drawings.

DESCRIPTION OF THE DRAWINGS

FIGS. 13 and 14 are cross-sectional views taken along the lines XIII—XIII and XIV—XIV in FIG. 2;

FIG. 14A is a cross-sectional view comparable to that in FIG. 14, but having a modified shape;

FIG. 20 is an exploded front view of the glass-supporting transom construction including the extrusions forming its window frame but not including the glass pane;

FIG. 21A is a cross-sectional view similar to FIG. 21, but including a bottom channel adapter for attaching the bottom extrusion of the window assembly to a base partition panel having a flat top;

DETAILED DESCRIPTION OF PREFERRED EMBODIMENTS

Figure 1:
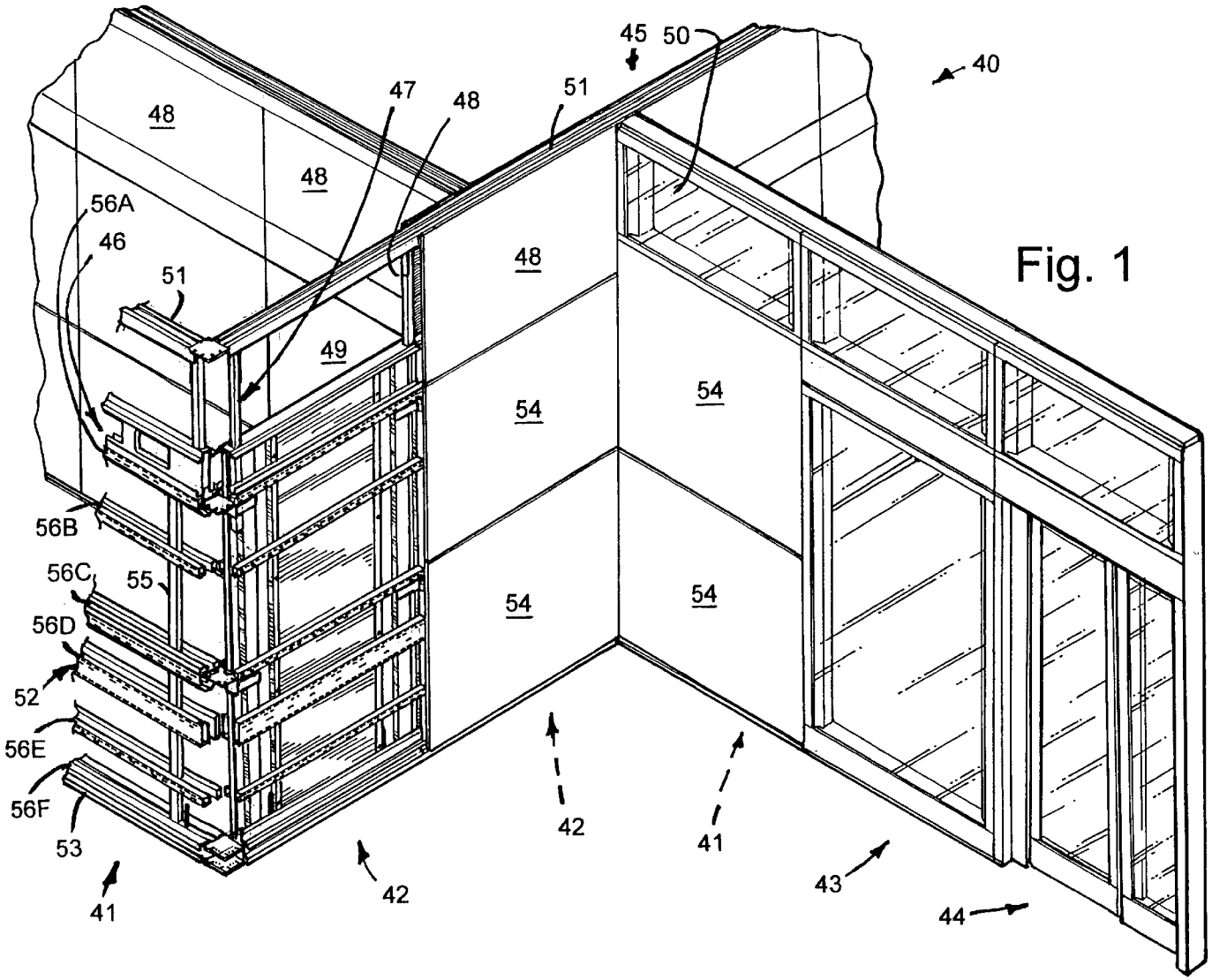
FIG. 1 is a perspective view of a wall structure for dividing building space embodying the present invention, including several different freestanding base panels including an internally open partition panel, a sound-deadening partition panel, a glass-supporting partition panel, and a doorway-supporting partition panel, and further including an overhead system comprising a structural expressway construction, a transom subframe, covers for the subframe, and a glass module attachable to the subframe.

For purposes of description here, the terms "upper," "lower," "right," "left," "rear," "front," "vertical," "horizontal," and derivatives thereof shall relate to the invention as oriented in FIG. 1 with a person standing adjacent the wall system. However, it is to be understood that the invention may assume various alternative orientations, except where expressly specified to the contrary. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting unless the claims by their language expressly state otherwise.

A wall system 40 (FIG. 1) for dividing building space includes several different freestanding base panels such as an internally open partition panel 41 (called "Segment," see application Ser. No. 08/767,817 referred to above), a sound-deadening/fire resistant partition panel 42 (called "Solid Quotient"), a glass-supporting partition panel 43 (called "Glass Quotient"), and a doorway-supporting partition panel 44 (called "Portal" or "Entry"), and further includes an overhead system 45 attached atop the base panels that extends to a building ceiling. The overhead system 45 includes a structural "expressway" or wireway construction 46 (called "Expressway"), an extendable partition-to-ceiling subframe 47 (called "Transom" subframe) attached to a top of the structural expressway construction 46 and that extends into mating engagement with a ceiling channel 51, overhead covers 48 (called "Transom" covers) for covering the open area 49 between the ceiling channel 51 and the structural expressway construction 46, and a glass-supporting window construction 50 (called "Clerestory") also attachable between a ceiling channel 51 and atop the structural expressway construction 46 between pairs of the subframes 47. Advantageously, the base panels 41–44 and overhead system including components 46–48, 50, and 51 provide significant flexibility in their ability to be configured to accommodate personal and business needs, and in their ability to be reconfigured and arranged to accommodate changing personal preferences, work habits, and business/work processes. Further, reconfiguration and rearrangement can be accomplished with a minimum of "new" parts and labor, but with a maximum of speed and efficiency.

Figures 2, 3:
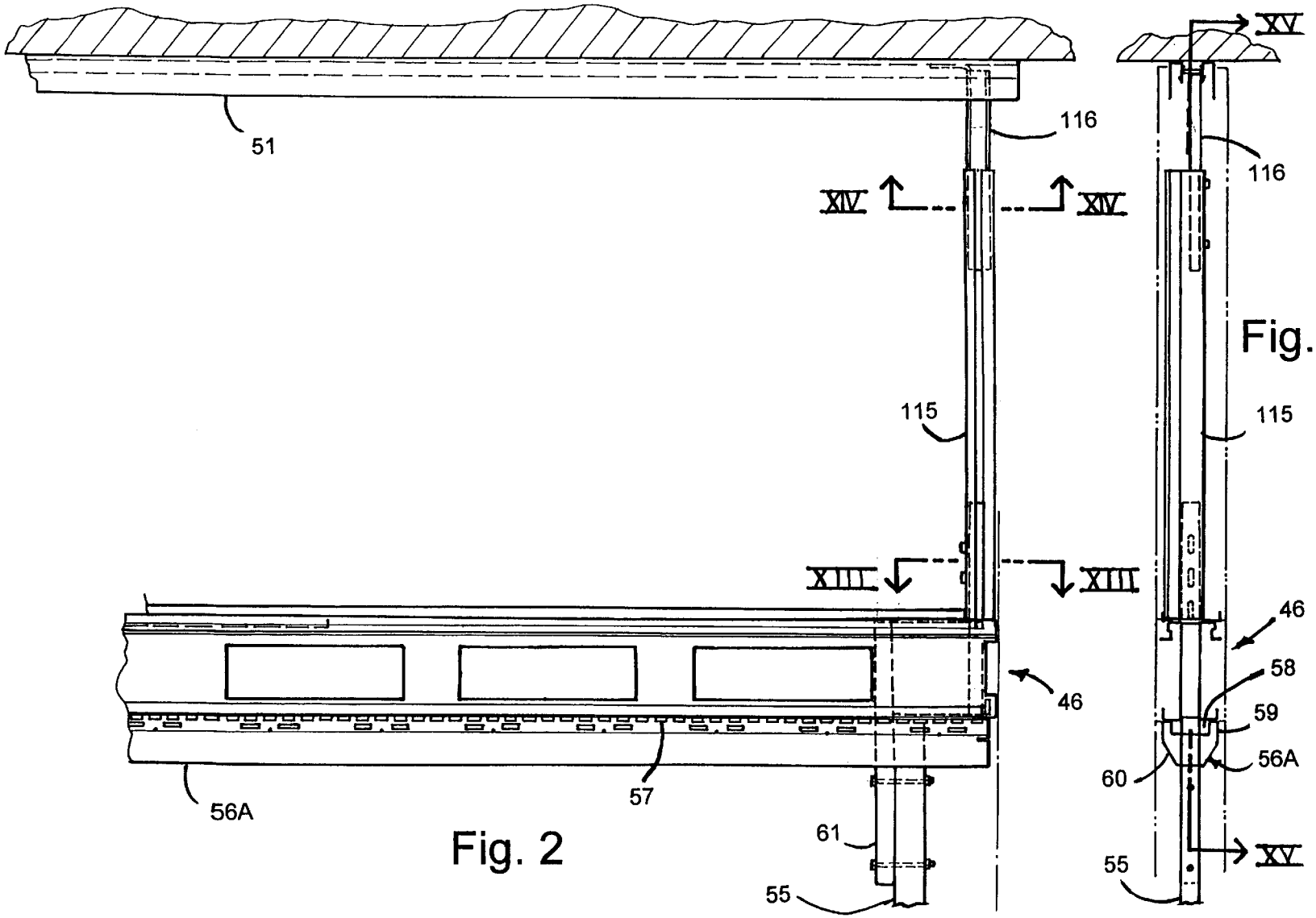
FIGS. 2 and 3 are fragmentary front and end views of the overhead system as attached to the internally open partition panel as shown in FIG. 1, the covers being removed to better show the expressway construction and the transom subframe.
Figures 4, 5, 6:
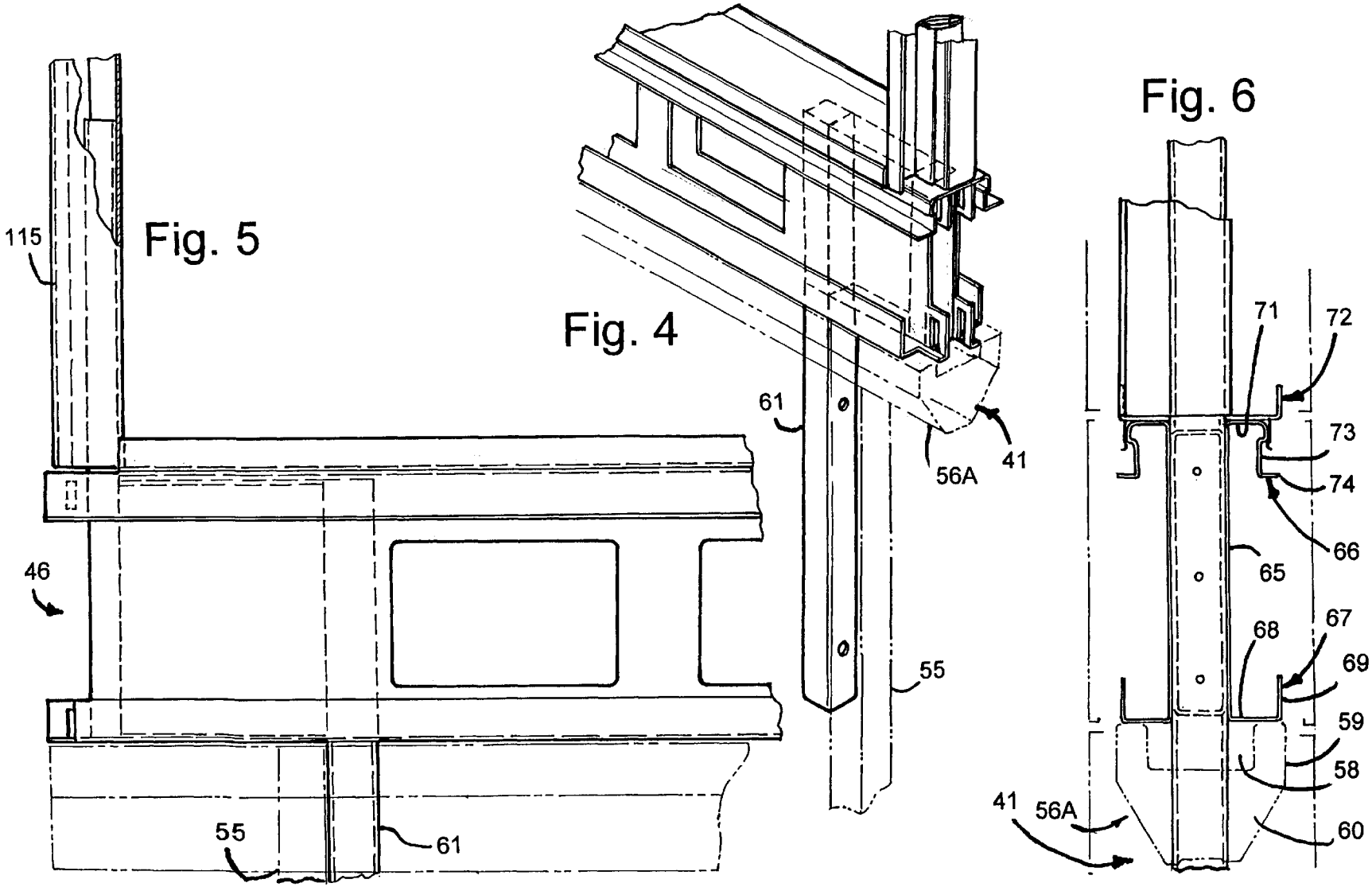
FIGS. 4–6 are fragmentary perspective, front and end views of an end of the structural expressway construction including a bottom part of the transom subframe, the opposite end being a mirror image thereof.

An exemplary internally open partition panel 41 (FIG. 1) is described in detail in a patent application Ser. No. 08/579,614, filed Dec. 26, 1995, entitled PARTITION SYSTEM, referred to above. Nonetheless, the partition panel 41 is described below in sufficient detail for an understanding of the present invention. The partition panel 41 includes a frame 52, a floor channel 53 supporting the frame 52 on a floor surface, and removable partition cover panels 54 that cover the frame 52. The frame 52 comprises at least two spaced apart vertical uprights 55, and a plurality of horizontal frame members 56A–56F. It is noted that some of the horizontal frame members 56A–56F can be eliminated, and that not all frames 52 include every single one of the horizontal frame members 56A–56F. Each of the horizontal frame members 56A–56F include front and rear outboard faces with a horizontal row of slots 57 that can be selectively engaged to support furniture units thereon. The possible furniture units include a variety of different furniture components, such as storage bins, shelves, worksurfaces, other partition panels, and the like, that are attachable to or associated with the partition system. The frame 52 is characteristically very open, so that it accommodates a high density of wires and utilities, which is desirable in modern offices that make extensive use of computers, communication equipment and cabling, and other electrical equipment. The top horizontal frame member 56A (FIGS. 2 and 3) is tubular, and defines an upwardly facing channel 58, outboard side faces 59 with the slots 57 therein, and angled reinforcement flanges 60 that extend downwardly to sides of the uprights 55. A vertical opening is formed in channel 58 of top horizontal frame member 56A at a location inboard of the associated upright 55. A tubular bayonet-like post connector 61 (FIG. 2) attaches to the inboard side of the upright 55, and extends upwardly through the top horizontal frame member 56A. The connector 61 is located inboard of the end of the top horizontal frame member 56A, in a location that would interfere with attachment of window construction 50, since the side extrusions of the window construction 50 are located at the vertical side edge of the window construction 50 and are not located several inches inboard. Expressway construction 46 moves the structural support from inboard at connector 61 to the vertical side edge, as discussed below.

Figure 7:
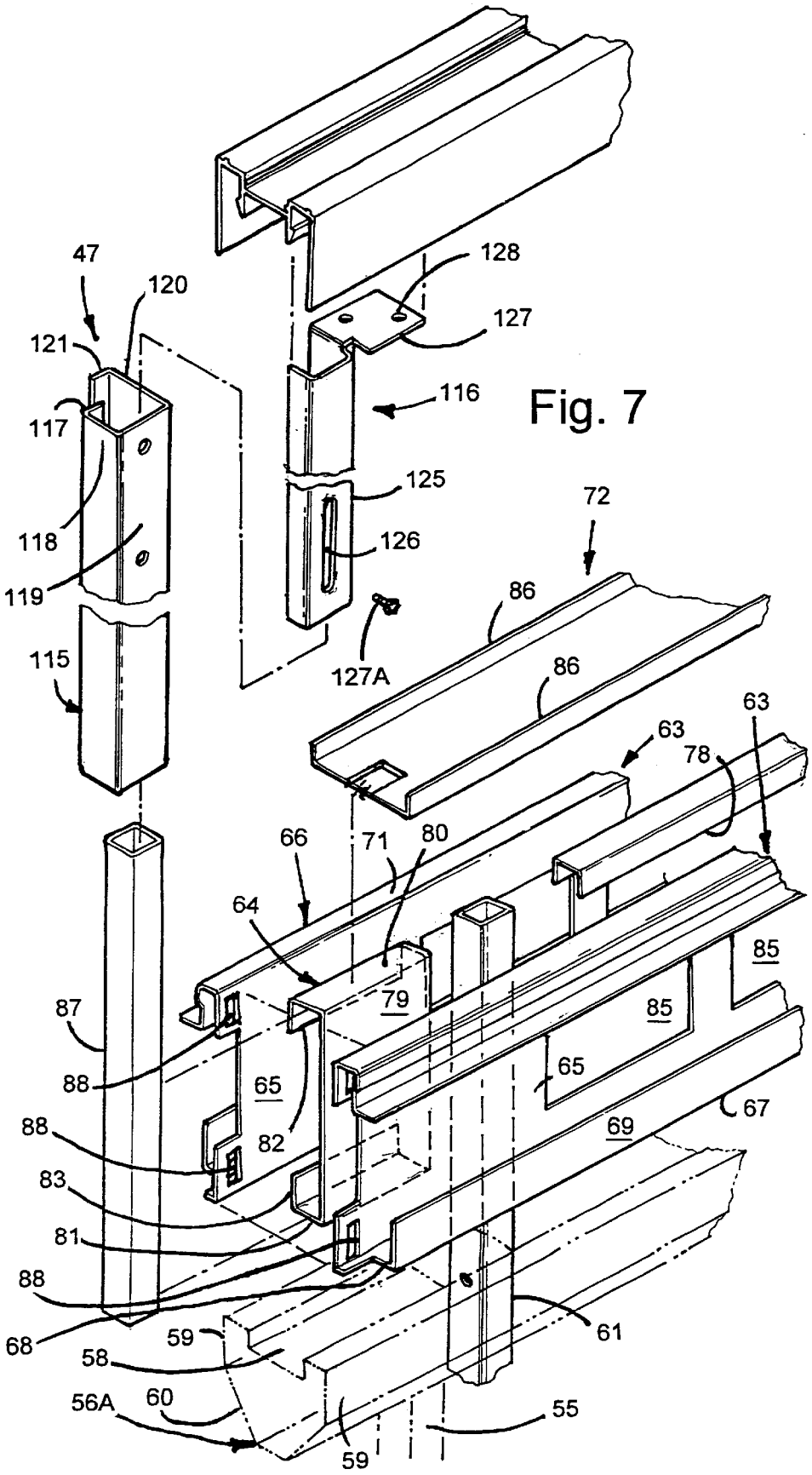
FIG. 7 is an exploded perspective view of the structural expressway construction shown in FIG. 4, including structure for attachment to an internally open partition panel.
Figure 11:
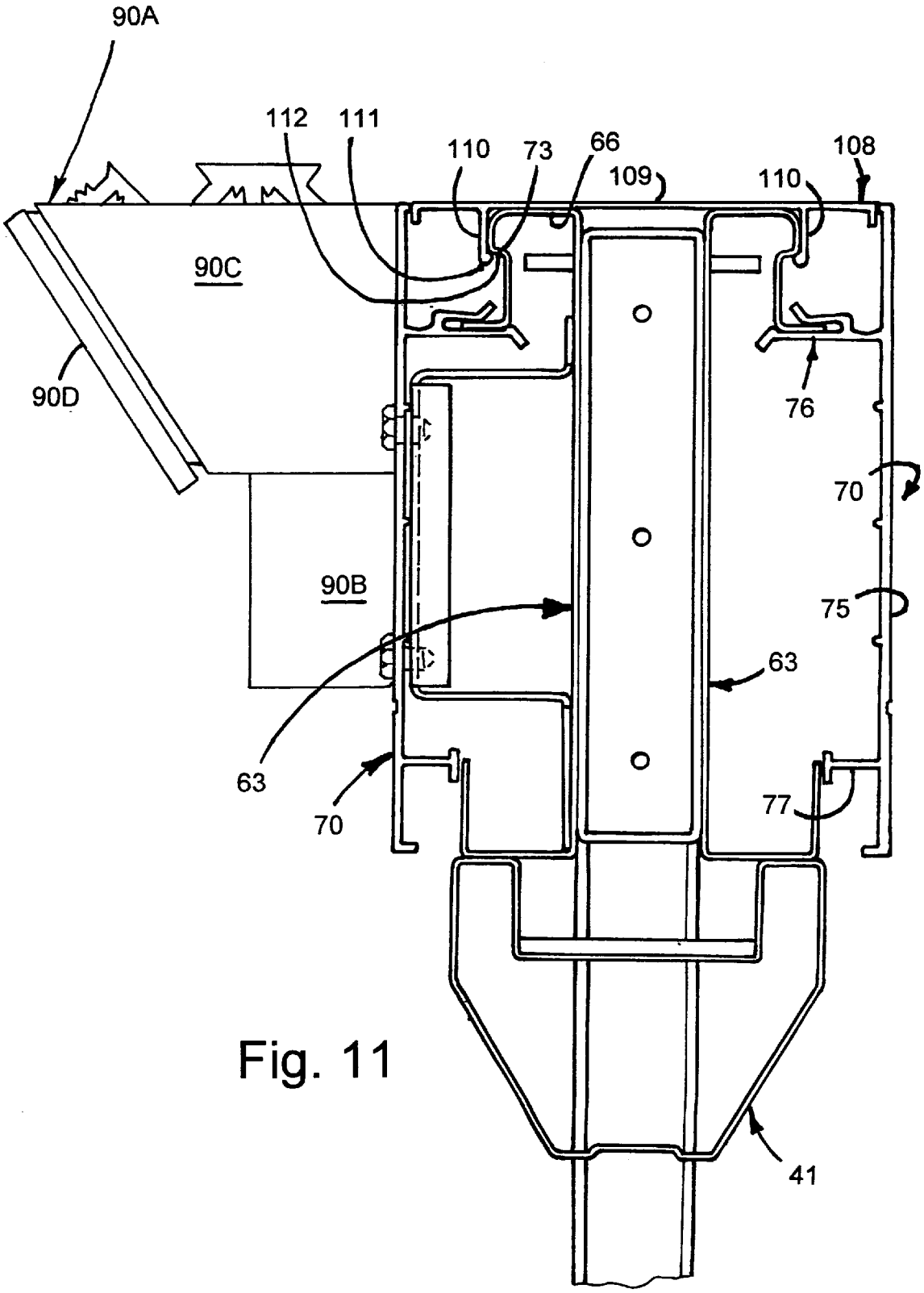
FIG. 11 is a fragmentary end view showing the structural expressway construction attached atop an internally open partition panel, but with the top of the structural expressway construction covered because there is no transom subframe attached thereto.

The structural expressway construction 46 (FIG. 7) includes outwardly facing, opposing C-shaped channels 63 secured by welding to opposite sides of a torque box bracket 64 at each end. The C-shaped channels 63 have a vertical center flange 65, an S-shaped top flange 66, and an L-shaped bottom flange 67. The L-shaped bottom flange 67 (FIG. 8) includes a horizontal leg 68 that rests on the top of top horizontal frame member 56A, and an up leg 69 for abuttingly supporting an expressway cover 70 (FIG. 11). The S-shaped top flange 66 (Pig. 6) includes a first horizontal leg 71 that supports a U-shaped expressway top channel/plate 72, a down leg 73 that extends downwardly from horizontal leg 71, and a second/outer horizontal leg 74 that extends outwardly from down leg 73. Expressway cover 70 (FIG. 11) includes an aesthetic flat panel 75 for covering the structural expressway construction 46. An upper clip 76 is configured to resiliently, frictionally engage the second horizontal leg 74 and, when attached, is further configured to bias a lower foot 77 into abutting engagement with the up leg 69.

The torque box bracket 64 (FIG. 7) is C-shaped, and includes a center leg 79, top and bottom horizontal legs 80 and 81, a down leg 82 extending from top leg 80, and an up leg 83 extending from bottom leg 81. The center leg 79 is attached to one C-channel 63, and the down and up legs 82 and 83 are attached to the other C-channel 63. The expressway construction 46 constructed from welding the C-channels 63 and the torque box brackets 64 together is sufficiently rigid for most applications unless the expressway is more than two or three feet long, or is used in a relatively high stress environment. In such case, a U-shaped stiffener 78 is secured between C-channels 63 along a top side and a bottom side thereof. The ends of stiffener 78 are spaced from the torque box bracket 64 at each end of the expressway construction 46 to form a pocket for receiving the upper end of tubular connector 61. Tubular post connector 61 is secured to the expressway construction 46 by screws that extend through the center flange 65 threadably into the tubular connector 61. Optionally, the torque box bracket 64 also includes a flange for receiving the connector attachment screws. Center flange 65 includes a plurality of square or rectangular cutouts 85 to reduce its weight and to allow cross over of wiring and cabling that is routed along the cavities defined by and between the C-shaped channels 63. The torque box bracket 64 is also spaced from the associated ends of the C-shaped channels 63 to form a second pocket 87A at the end of the expressway construction 46. The second pocket 87A is configured to mateably receive a second tubular bayonet-like post connector 87. Notably, the post connector 87 can be square (see FIG. 13) or rectangular (see FIG. 14A) or U-shaped (see FIG. 14). A lower portion of the tubular connector 87 is connected to the C-channels 63 by screws that extend through apertures 88 in the C-channels 63, and an upper portion thereof is connected to the transom subframe 47, described below. The outer second connector 87 is welded or screwed to the C-channels 63 to form a rigid structural expressway frame adapted to torsionally support loads at the inboard connector 61 and at the outboard connector 87. Notably, the torque box bracket 64 is designed to move structural support from the inboard location of the inboard connector 61, which is supported by the partition frame 52 inboard of the vertical side edges of the partition panel 41, and move the support to a location at outer connector 87, which is at and aligned with the vertical side edge of the partition panel 41. The shape of the torque box bracket 46 and its welded attachment to the C-channels 63 makes this arrangement particularly structurally strong and torsionally resistant to torsional loads, such as those that occur when a utility support bracket 89 (FIG. 8), a work tool rail 90, work tool accessories, lighting fixtures, and the like, are attached to the expressway construction 46, as described below.

Figure 8:
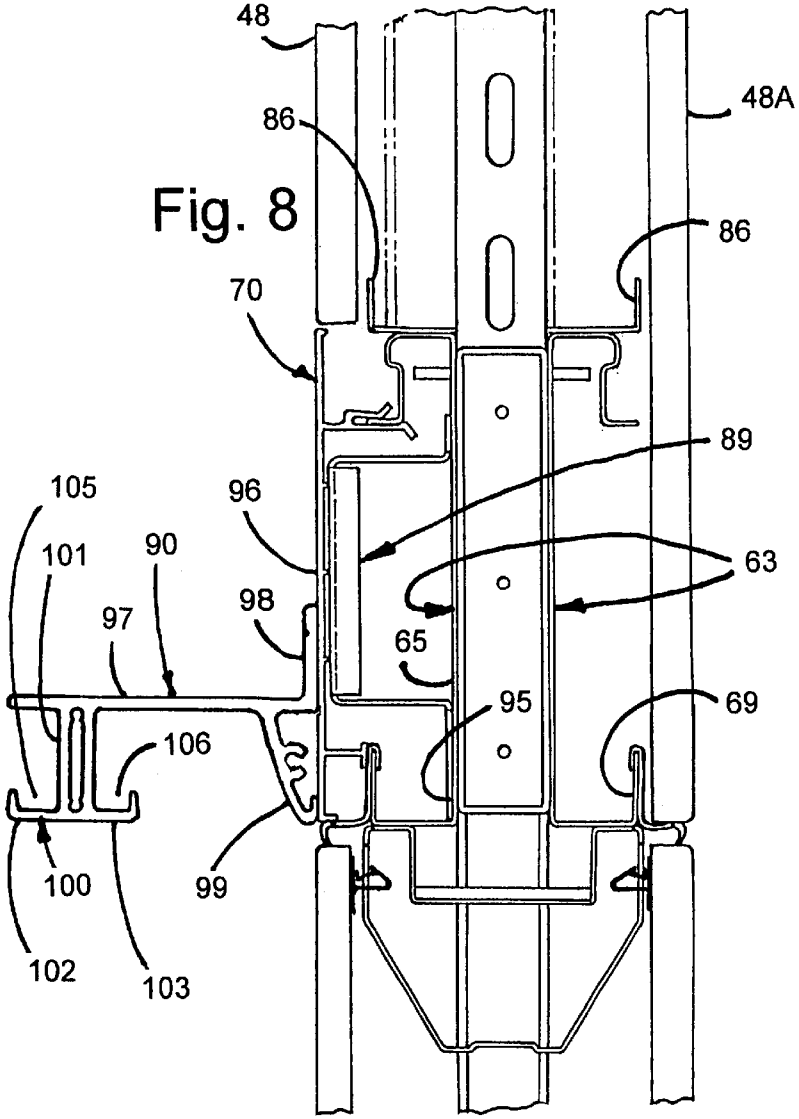
FIG. 8 is a fragmentary end view of the structural expressway construction shown in FIG. 5 including a utility support bracket and a work tool rail.

The top plate 72 (FIG. 7) includes up legs 86 at its outer side edges that are vertically aligned with the up legs 69 at the bottom of the C-channels 63. In an environment where it is desirable to de-emphasize the expressway, the elongated transom covers 48A are extended downwardly over the expressway construction 46, and include connectors that engage the up leg 69 at the bottom of the C-channels 63 (FIG. 8, right side of the drawing). In environments where it is desirable to emphasize or highlight the expressway, the expressway covers 70 are used, and the transom covers 48 are cut short of the expressway construction 46, and include connectors that engage the up legs 86 on the top plate 72 (FIG. 8, left side of the drawing). (Also, see FIG. 1, where the illustrated center wall section is not "expressed" but instead includes a single transom cover 48 that covers the expressway construction 46, and where the upper/left wall section does include an "expressed" expressway having a transom cover 48 as well as an expressway cover 70).

Figure 10:
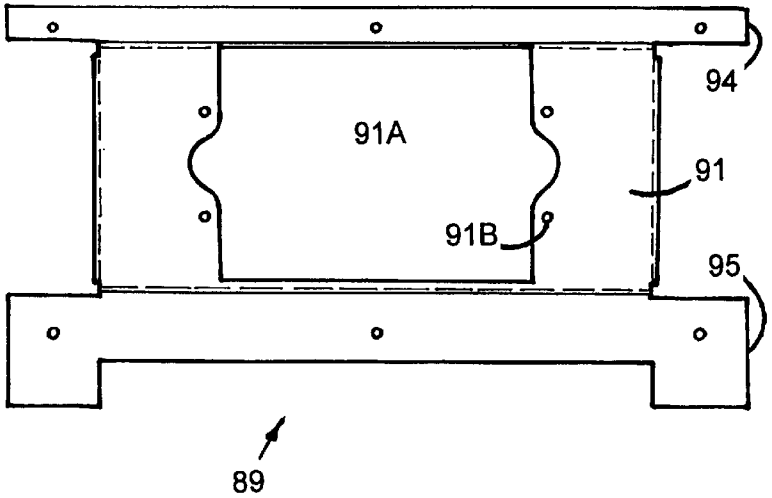
FIGS. 9 and 10 are perspective and plan views of the support bracket shown in FIG. 8.
Figure 9:
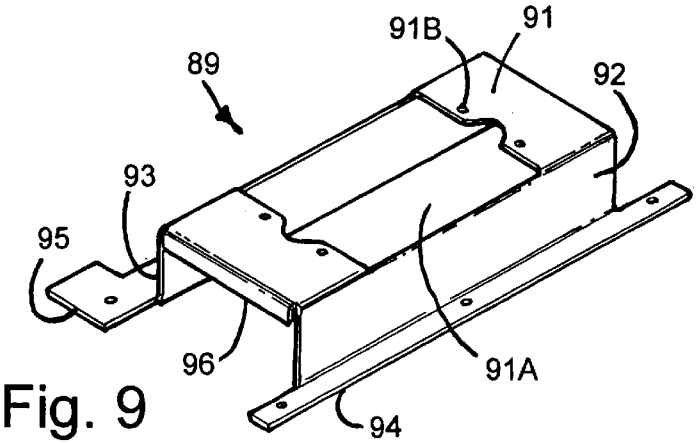

The utility support bracket 89 (FIGS. 8–10) has a hat-shaped cross section, including a flat center flange 91 (FIG. 9), opposing side flanges 92 and 93, and attachment flanges 94 and 95 that extend parallel to center flange 91. Reinforcement flanges 96 are formed at the ends of center flange 91 to reinforce the center flange 91. The bottom attachment flange 95 is extended to space the center flange 91 of support bracket 89 above the up leg 69 of C-channel 63 (FIG. 8) when the support bracket 89 is positioned inside of the C-channel 63. When so positioned, the attachment flanges 94 and 95 abut the center flange 65, and are screwed to the center flange 65. The opposing side flanges 92 and 93 position the center flange 91 inboard of but adjacent the flat panel 75 of expressway cover 70, for supporting an electrical junction or outlet in a mating opening in the expressway cover 70. The center flange 91 includes an opening 91A shaped to mateably receive an outlet receptacle or electrical junction box, and screw holes 91B for screw attaching the outlet receptacle or junction box in the opening 94. The utility support bracket 89 structurally supports accessories such as work tool rail 90 and/or lighting fixture 90A.

Where desired, a work tool rail 90 (FIG. 8) is attached to an outer surface 96 of the expressway cover 70. The work tool rail 90 is an extrusion having a horizontally extending structural wall section 97, an up attachment flange 98 for securement through the expressway cover 70 into the utility support bracket 89, and a down attachment flange 99 that abuts a lower edge of the expressway cover 70 to hold the structural wall section 97 in cantilever outwardly from the expressway construction 46. An inverted T-shaped section 100 is supported at an outer end of the structural wall section 97 and hangs downwardly. The T-shaped section 100 includes a stem portion 101 and arms 102 and 103, each having an up lip 104 along their outer edges. The work tool rail 90 is configured to define a pair of tracks 105 and 106 that are adapted to movably or non-movably support work tool accessories, such as a marker board, tack board, or the like, that can be moved/positioned along the wall in desired individual, overlapping and/or non-overlapping positions.

Where desired a lighting fixture 90A (FIG. 11) can be attached to utility support bracket 89 and expressway construction 46. The lighting fixture 90A includes a ballast housing 90B, a light bulb housing 90C, and lens 90D. It is contemplated that various fixtures can be used in place of fixture 90A.

It is contemplated that the structural expressway construction 46 may be used in environments where an overhead system is not needed or is not desired. In such circumstance, a top expressway cover 108 (FIG. 11) is used to aesthetically cover the expressway construction 46. The top expressway cover 108 includes a flat top panel 109 with a textured or otherwise treated, visually acceptable top surface. A pair of spaced apart resilient fingers 110 extend downwardly from the flat panel 109. The fingers 110 include hooks 111 on their end, that are configured to frictionally engage a ridge 112 or other feature located generally in the middle of the down leg 73 of S-shaped top flange 66 of C-channels 63. The edges 113 of the flat panel 109 end at a location adjacent the top edge of the expressway covers 70, and can include a ridge or feature to ensure alignment with the edge of the expressway covers 70 at the corners thus formed.

Figure 12:
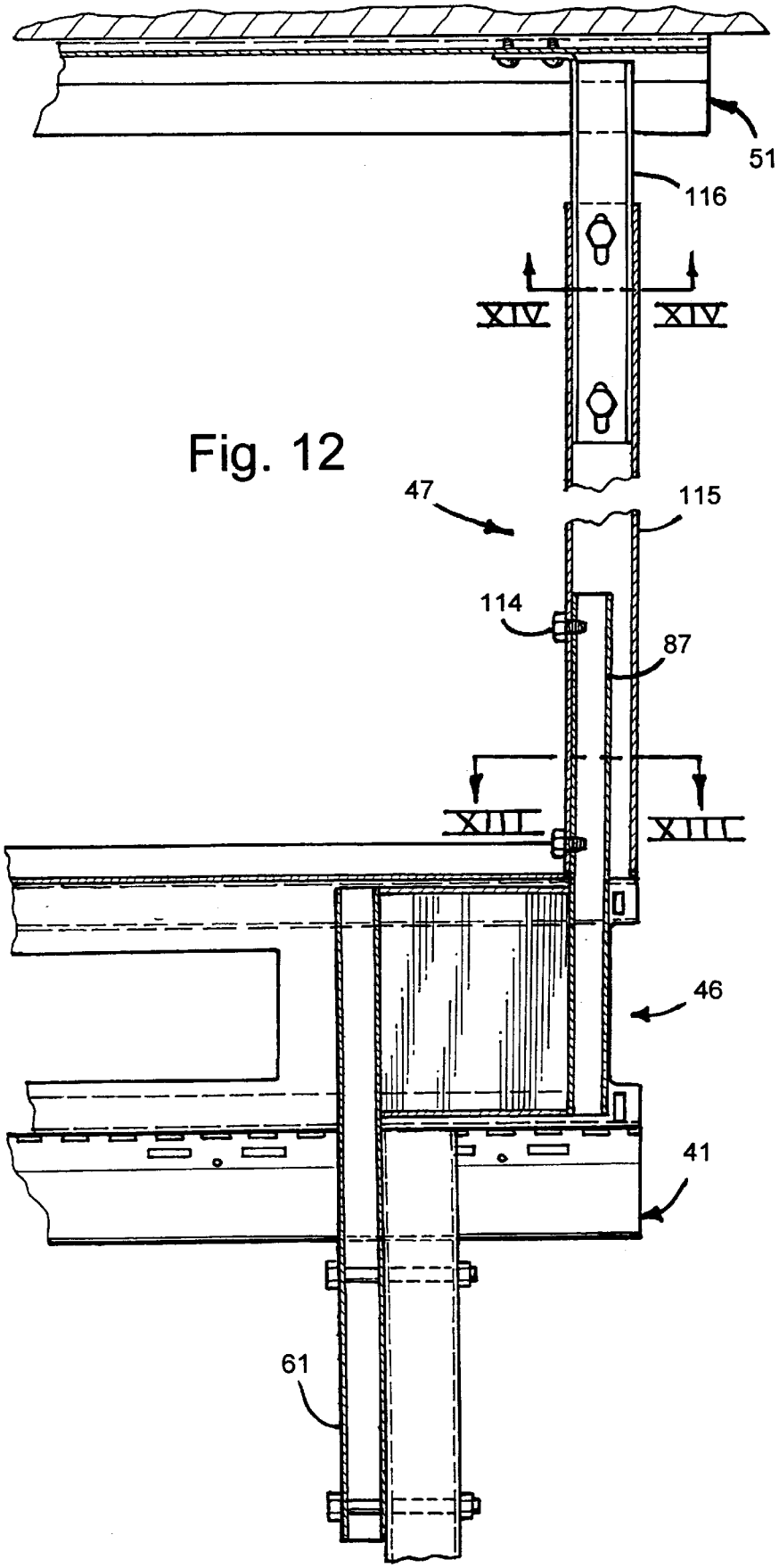
FIG. 12 is an enlarged fragmentary side view similar to FIG. 2 but partially in cross section.

The transom subframe 47 (FIG. 12) is screw attached to a top of the outer connector 87 using screws 114. Transom subframe 47 includes a stationary lower "G" post or frame member 115 and an upper bracket or ceiling-channel-engaging bracket 116 that is extendable on lower post 115 for attachment to ceiling channel 51. The stationary lower post 115 has a G-shaped cross section (FIG. 13), and includes circumferentially extending flat flanges including inner flange 117, first transverse flange 118 positioned adjacent a vertical side edge 123 of the partition panel 41, intermediate side flange 119, second transverse flange 120, and outermost edge flange 121. Notably, intermediate side flange 119 can include bend 119A that stiffens flange 119 and that also defines a recess to receive a rectangular tubular connector 87A. The cross section of lower section 115 is chosen for several reasons. The flanges 118–121 define a relatively large cross section, thus providing improved torsional stability over a smaller cross section. At the same time, the space 122 between the outermost edge flange 121 and the vertical side edge 123, and the concurrent space 122A between the outermost edge flange 121 and the inner flange 117, allows an enlarged glass-supporting window construction 50 to be attached to the subframe 47 from a direction 124, as discussed below, thus offering improved aesthetics because the visual appearance of the "post" area is smaller (at least from one side). Also, the space 122 provides a pocket for receiving an edge of the frame of the window construction 50, thus providing a more secure and more stable arrangement. Also, the flanges 118–121 define an internal cavity with corners 125A for mateably receiving different connectors. For example, compare FIGS. 13, 14, 14A, 28 and 29. Specifically, the connectors for connection to the different partition panels 41–44 are sometimes different shapes, and the G-post 115 is configured to mateably receive and engage each of these different shapes. The connector 87 mateably engages the corner defined by flanges 119 and 120, and is screw attached by the screws 114 which threadably engage flange 120. Notably, by reversing G-post 115, the recess for receiving the window assembly 50 is relocated to an opposite side of the wall system 40.

The upper bracket 116 (FIG. 7) includes a U-shaped lower end section 125 that mateably engages the G-post 115 at flanges 118–120 (FIG. 14). A slot 126 (FIG. 7) in the intermediate flange of the end section 125 receives a screw 127A (FIG. 14) that threadably engages the flange 119 of G-post 115 to secure the end section 125 to the post 115. The slot 126 allows the upper bracket 116 to telescopingly extend on G-post 115, to adjust to different ceiling heights. Also, the upper bracket 116 comes in different lengths, or can be cut on site, to allow for different ceiling heights. The upper end of upper bracket 116 includes a horizontal flange 127 (FIG. 7) that extends laterally from one side of the U-shaped lower end section 125. The flange 127 has a pair of holes 128 for receiving screws to attach the flange 127 to the ceiling channel 51.

Figure 15:
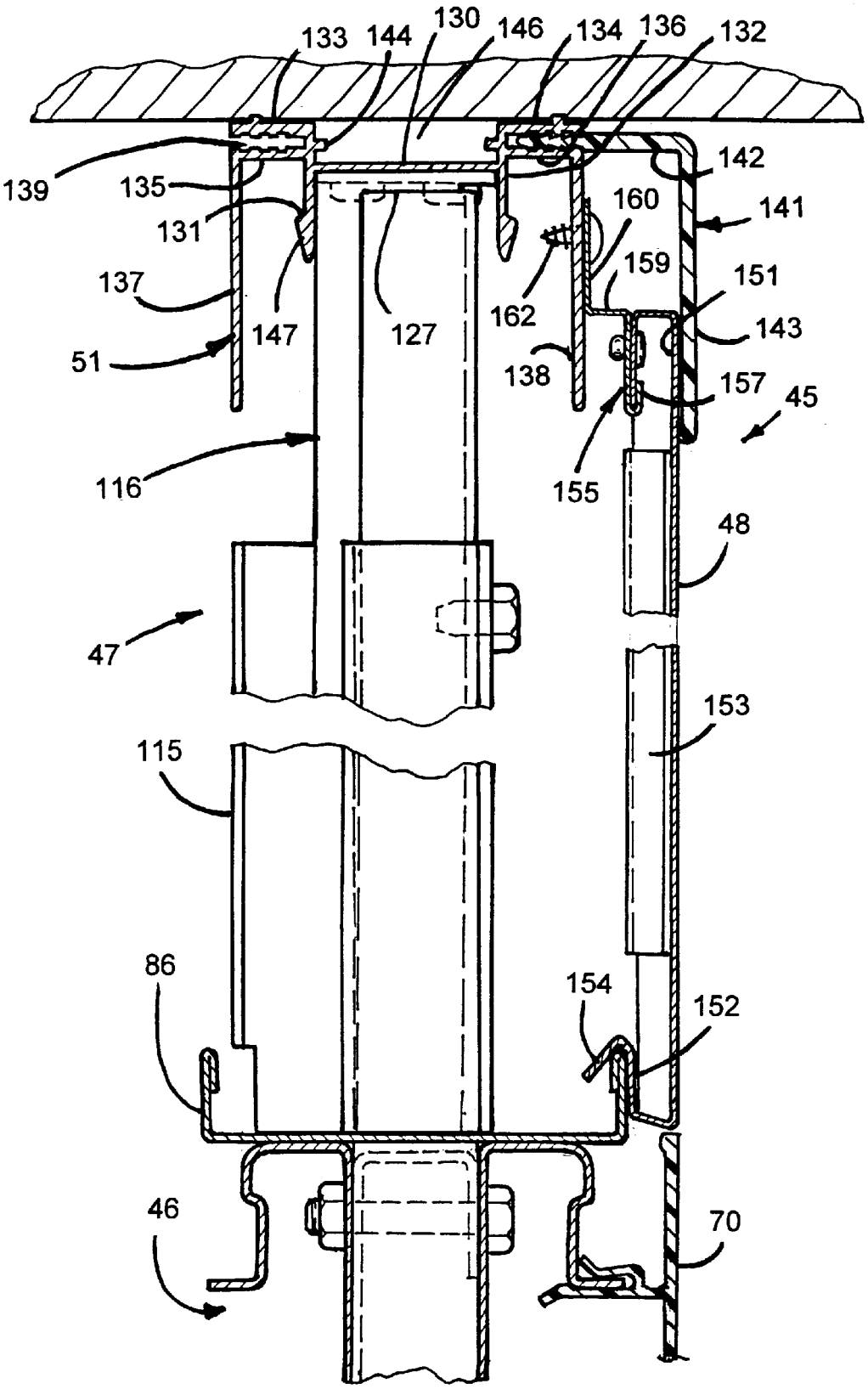
FIG. 15 is an enlarged fragmentary cross-sectional view taken along the line XV—XV in FIG. 3.

Ceiling channel 51 (FIG. 15) is an extrusion including a center flange 130, perpendicular vertical flanges 131 and 132, ceiling-abutting flanges 133 and 134, lateral flanges 135 and 136 that extend parallel ceiling-abutting flanges 133 and 134, and outer down flanges 137 and 138. The ceiling-abutting flanges 133 and 134 define recesses 139 with lateral flanges 135 and 136, respectively. An L-shaped trim piece 141 includes a leg 142 with ribs configured to frictionally engage the recess 139 as the leg 142 is pressed into the recess 139. The trim piece 141 is shaped to aesthetically cover the space along the building ceiling at a top of the overhead system 45 adjacent the building ceiling. The trim piece 141 further includes a down leg 143 that extends downwardly, overlappingly onto a top edge of the transom cover 48, as described below. The vertical flanges 131 and 132 extend downwardly below the center flange 130, defining a recess for mateably receiving the attachment flange 127 of upper bracket 116 of transom subframe 47. The ceiling-abutting flanges 133 and 134 combine with the vertical flanges 131 and 132 to space the center flange 130 away from the building ceiling, thus providing room for screws that secure the attachment flange 127 of the upper bracket 116 to the center flange 130 of the ceiling channel 51. It is noted that the inner portions of the vertical flanges 131 and 132 that extend above the space center flange 130 can have protrusions 144 (FIG. 15) or can have angled edges 145 (FIG. 22) that define a dovetail groove. These features 144 or 145 define a space 146 that is shaped to telescopingly capture an in-line tongue-like connector plate (not specifically shown) that telescopes into aligned ceiling channels 51 in the spaces 146 to align and anchor adjacent ceiling channels 51. The lower edges of the vertical flanges 131 and 132 can include enlarged ridges 147 (FIG. 15) or webs 148 (FIG. 22) that increase the stability of the flanges 137 and 138.

Figures 16, 16A:
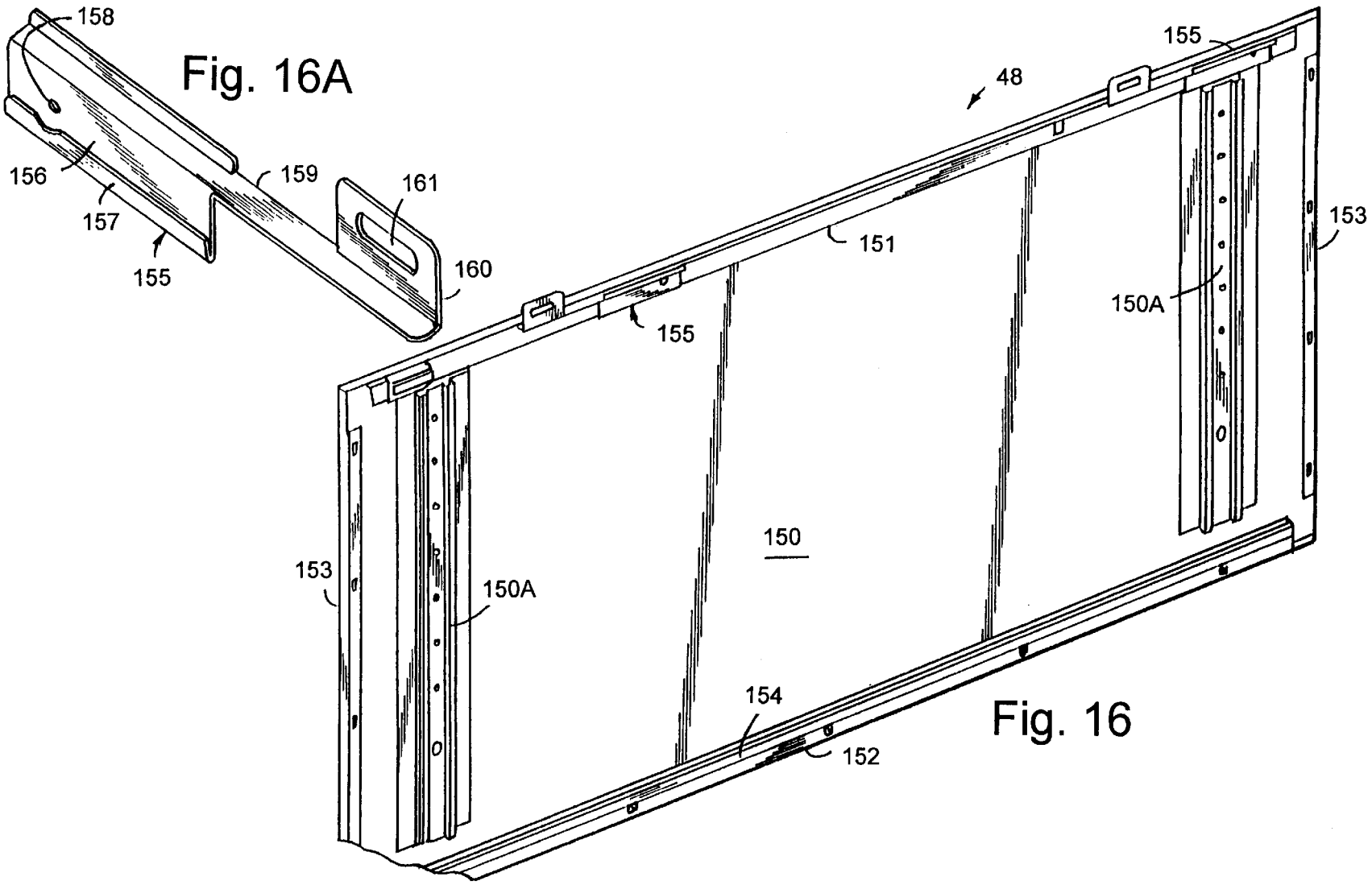
FIG. 16 is a perspective view of a rear side of the transom cover shown in FIG. 15.
FIG. 16A is a perspective view of a top connector on the transom cover shown in FIG. 16.

The transom covers 48 (FIG. 16) include a large sheet metal panel 150 With top, bottom, and side edge flanges 151, 152, and 153, respectively, formed thereon for stiffening the panel 150. Additional stiffeners 150A can also be added. It is noted that, alternatively, the transom covers 48 can be made from a large panel of composite material or other lightweight material with edge extrusions or rollforms attached to its edges and back surface for strength. The bottom edge flange 151 includes a turned or hooked flange 154 forming a downwardly facing hook-shaped connector for matingly engaging the up flange 86 on top plate 72 on expressway construction 46 (FIG. 15), or for matingly engaging the up leg 69 on the bottom L-flange 67 on the C-channel 63 of the expressway construction 46 (FIG. 8, right side of drawing). Attached along a top of the top edge flange 151 is a top connector 155. The top connector 155 (FIG. 16A) includes a flag-shaped attachment flange 156 with a reversely bent lip 157 that is adapted to receive the exposed edge of the top edge flange 151 of panel 150. A screw is extended through a hole 158 in the attachment flange 156 and threadably into the top flange 151 to secure the top connector 155 in place on the top edge flange 151. Alternatively, the top connector 155 can be welded, adhered, or otherwise secured. An elongated bendable/flexible arm section 159 extends from attachment flange 156, and a tab 160 with a slot 161 therein extends from the end of the elongated arm section 159. A screw 162 (FIG. 15) is extended through the slot 161 and threadably into the down flange 137 (or 138) to attach the top connector 155 to the ceiling channel 51. The elongated arm section 159 is bendable, and permits the tab 160 to be aligned with the down flange 137 (or 138) as desired, such as to align with a screw hole. As noted above, the trim piece 141 is attached to a side of the ceiling channel 51 to cover the space immediately below the building ceiling adjacent the ceiling channel 51. At the same time, it is contemplated that the ceiling arrangement could be constructed without a ceiling trim piece. (See FIG. 22.)

Figure 17:
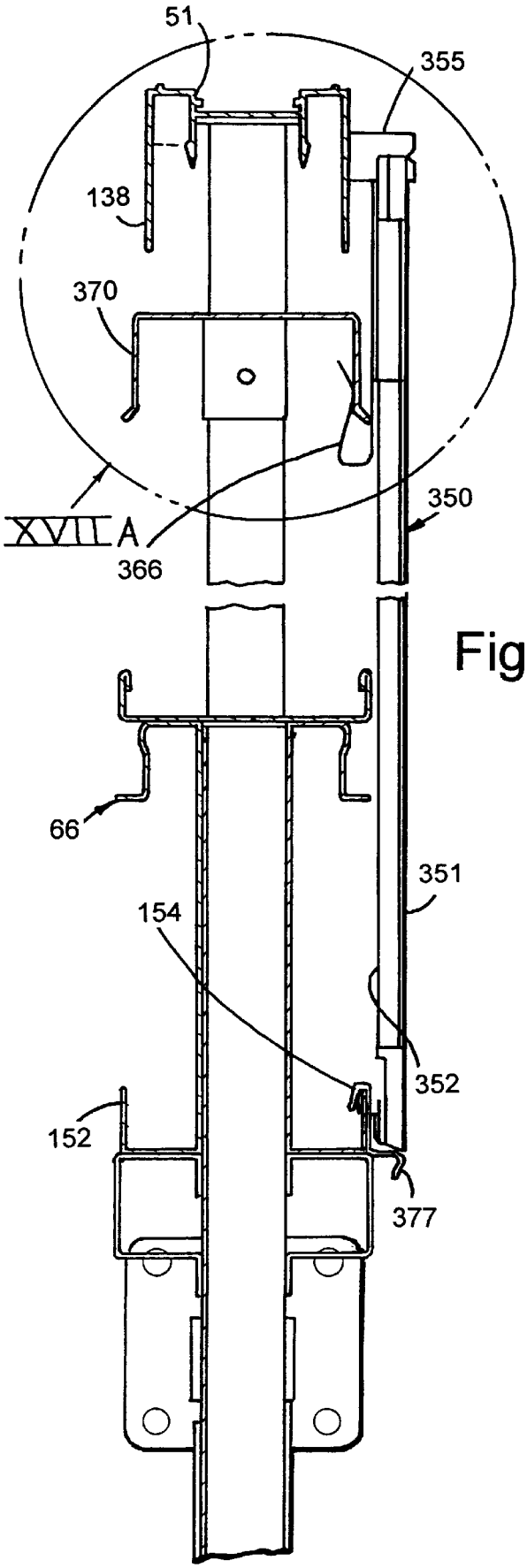
FIG. 17 is a fragmentary vertical cross section of a modified transom cover having a modified top connector, FIG. 17 being similar to FIG. 15.
Figure 17B:
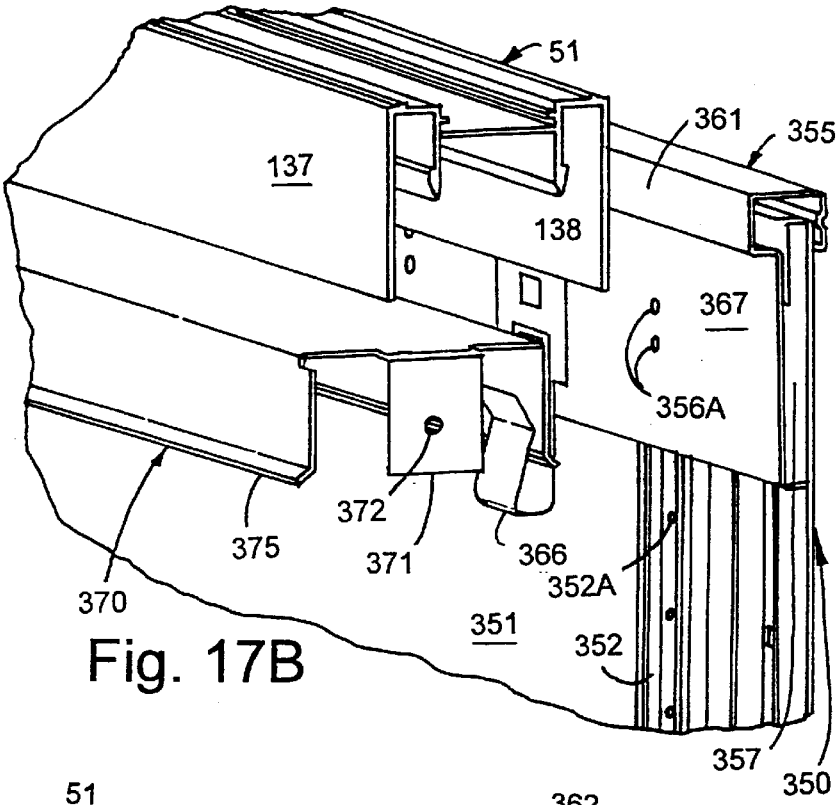
FIG. 17B is a perspective view of FIG. 17A.

A modified transom cover 350 supported by a modified top connector arrangement is shown in FIGS. 17–17B. Transom cover 350 includes a flat body 351 formed from sheet metal, composite material, or the like, and includes side edge stiffeners or side flanges 352. The top edge of the illustrated sheet metal body panel 351 is reversely bent to form a flat top section 353 and back flange 354. A top connector 355 for transom cover 350 includes a flat lower section 356 that extends parallel the body panel 351. Side and bottom flanges 357 and 358 are formed on or attached to lower section 356 to form a box-shaped platform that stably abuts a rear side of body panel 351.

The lower section 356 is screwed to the side edge stiffeners 352 at a desired height by extending screws through holes 356A into hole 352A (FIG. 17B). The upper section 359 of top connector 355 includes a rearwardly bent flange 360, a standoff flange 361 for abutting the outer flange 138 of ceiling channel 51, and a forwardly bent flange 362. A down flange 363 extends from forwardly bent flange 362, and includes a radiused ridge 364 that provides an aesthetic line for appearance and that abuts a face of the body panel 351. A rearward curled lip 365 on down flange 363 hides any burrs or unevenness on curled lip 365, and further provides a grip for securely retaining any upholstery or vinyl covering on transom cover 350. The curled lip 365 also prevents such upholstery or fabric from unraveling, which unraveling can be a problem in field-cut covers.

A J-shaped spring clip 366 includes an attachment leg 367 for attachment to lower section 356 and a resilient U-shaped lower leg 368. Attachment leg 367 includes tabs 369 configured and bent to securely engage the lower section 356 to secure the clip 366 to the top connector 355.

Figure 17A:
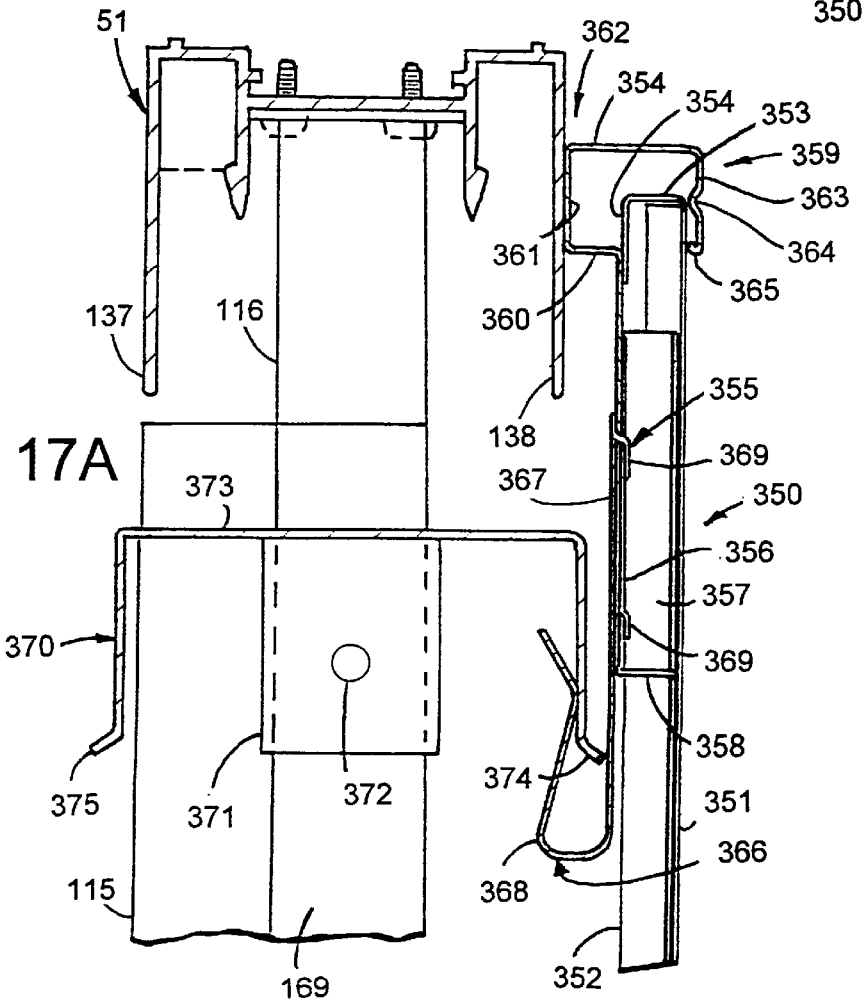
FIG. 17A is an enlarged view of the circled area XVIIA in FIG. 17.

An adapter bracket 370 (FIG. 17A) includes a lower end tab 371 shaped to mateably engage the G-post 115 of the transom subframe 47, and includes a hole 372 for screw attachment thereto. An inverted U-shaped section 373 extends from lower end 371 and includes arms with down flanges 374 and 375. Adapter bracket 370 is attached to the G-post 115 so that the down flange 374 (or 375) is engageable by the lower leg 368 of the spring clip 366 when the transom cover 350 is installed. An adapter bracket 370 is attached to each G-post 115.

To field cut the transom cover 350, the top connector 355 is removed by removing screws in holes 352A and 356A, and the upper edge of the cover 350 is then cut to a desired height. The top connector 355 is then re-attached by extending the screws through holes 356A into newly selected holes 352A in transom cover 350. The adapter brackets 370 are attached to the associated G-post 115 at a desired height. The transom cover 350 is then removably attached by extending spring clip 366 into mating engagement with down flange 374 of adapter brackets 370, and then by lowering the bottom hook connector 154 onto engagement with up flange 86. Notably, the transom cover 350 can include a flexible light seal 377 at its bottom if desired for improved aesthetics.

Figure 18:
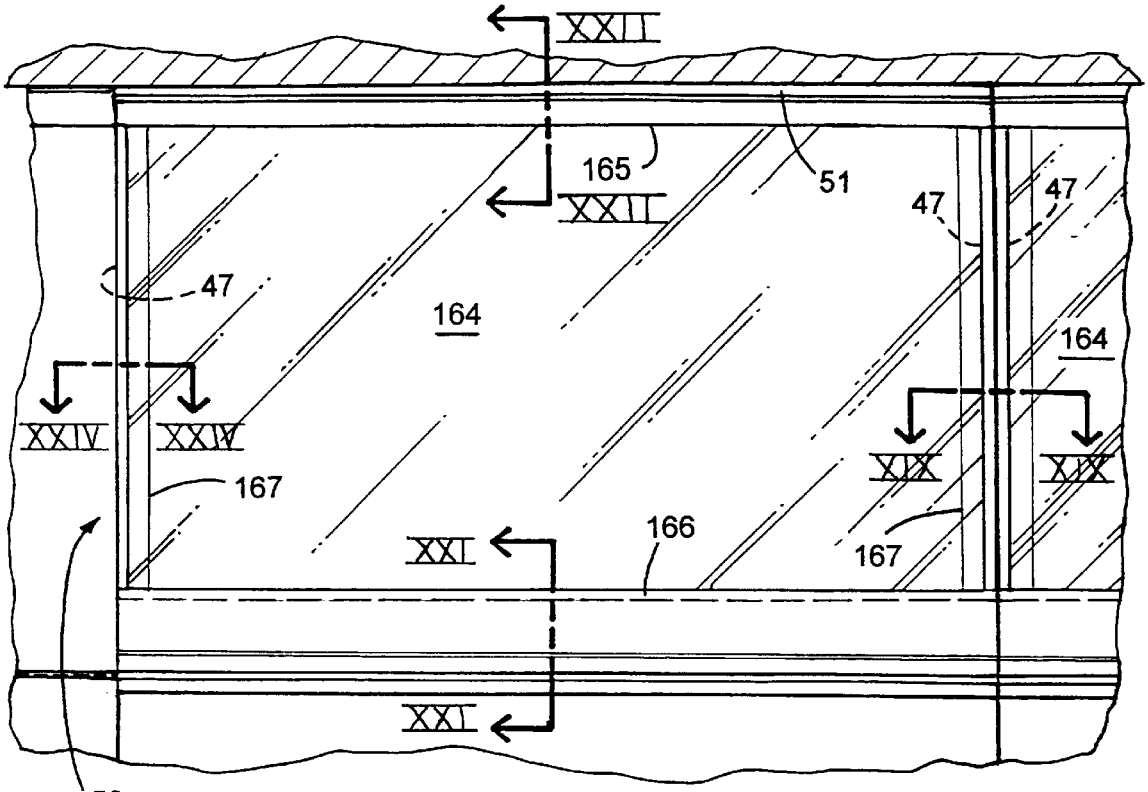
FIG. 18 is an enlarged fragmentary view of the glass-supporting window construction as shown in FIG. 1.
Figure 21:
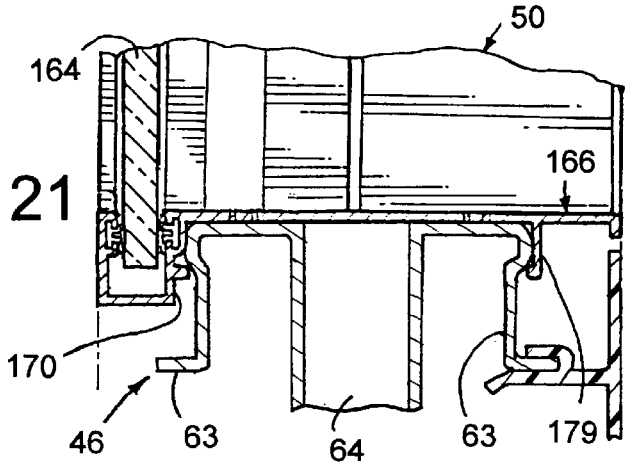
FIG. 21 is a cross-sectional view taken along the line XXI—XXI in FIG. 18.

The window construction 50 (FIG. 18) is also constructed to mate with and be located between a pair of the transom subframes 47, with the window construction 50 extending above the expressway construction 46 up to the ceiling channel 51. The window construction 50 includes a glass pane 164 located adjacent a front face 184 of the window construction 50, and a marginal structural frame for retaining the glass pane 164 including top, bottom, and side frame extrusions 165, 166, and 167, respectively. The marginal frame is designed to be constructed on the floor adjacent the wall system, and then (with or without the glass pane 164) be attached overhead by inserting the top edge into the ceiling channel 51, and then lowering the bottom edge onto the expressway construction 46. The bottom frame extrusion 166 (FIG. 21) is shaped to rest mateably atop the expressway construction 46. The bottom frame extrusion 166 includes spaced apart down flanges 170 and 179 that form a recess for mateably receiving the top of the structural expressway construction 46, with the down flanges 170 and 179 straddling the tops of the C-shaped channels 63. It is contemplated that the U-shaped top plate 72 will be eliminated when the window construction 50 is going to be used.

For "generic" base partition panels having a flat top with a different width, a bottom wall section adapter 168 is provided. The bottom wall section adapter 168 is attached to a top of the "generic" base partition by screws, or it can be otherwise secured to the expressway construction by a protrusion, ridge or groove on the expressway construction 46, or can be otherwise secured to a top of the base partition 41 by engaging a mating feature on a top of the base partition 41. It is specifically contemplated that the bottom wall section 168 can include down flanges or sections configured to engage the top plate 72 so that a bottom of combined bottom extrusion and adapter 166 and 168 nestingly releasably engages the top plate 72, as a means of retaining the bottom of the window construction 50 to the expressway construction 46.

The bottom extrusion 166 includes a U-shaped section having a pair of opposing flanges 169 and 170 that are located on a "front" side of the bottom extrusion 166, and that define a recess in which a glass edge support block 171 is positioned. A pair of inwardly facing grooves are formed in the opposing flanges 169 and 170 for supporting glass wipers/retainers 172 and 173. A lower edge of the glass pane 164 is rested on the support block 171, with the wipers 172 and 173 slidingly pressing on opposite sides of the glass pane 164 to stabilize it and to center the glass pane 164 on the support block 171. A second pair of spaced apart up flanges 174 and 175 extend from bottom wall section 168. The second up flanges 174 and 175 include hooked ends. A third up flange 176 also extends from bottom wall section 168 at a location remote from the first up flanges 169 and 170. The bottom extrusion 166 includes a flat panel 178 for forming a clean marginal inwardly facing edge around the glass panel 146. The hooked arm or flange 179 and a detent 180 on inner flange 170 extend from the bottom extrusion 166 and are adapted to matingly frictionally engage the up flanges 174 and 175 to retain the bottom wall section 168 to the bottom extrusion 166. The ends 181 and 182 of the bottom wall section 168 are configured to mate with the bottom extrusion 166 to provide a clean joint line therebetween. A spacer 177 can be used to support a center area of the bottom extrusion 166 and wall section 168 if desired. (See FIG. 30.) Notably, the glass pane 164 is secured in a position that is substantially flush with one face of the partition panel 41, and that is spaced significantly from a central plane of the partition panel 41. More specifically, the partition panel 41 defines a central plane 183 that extends longitudinally and vertically, and the glass pane 164 is offset toward the front face 184 of the partition panel 41 from the central plane 183, which front face is the same face from which the glass window construction 50 is installed.

Top frame extrusion 165 (FIGS. 22 and 23) includes first extrusion 165A having a flat panel 185 with a first end section 186 located at the front face 184, and a second end section 187 opposite first end section 186. First end section 186 includes an inverted U-shaped section 188 defining a recess 189 for receiving an upper edge 190 of the glass pane 164, with opposing notches for supporting glass wipers or gaskets 192 to retain the glass pane 164 and to center the glass pane 164 in the recess 189. The recess 189 is deep enough to allow the upper edge 190 of the glass pane 164 to be inserted "too far" into the recess 189, so that it allows the lower edge of the glass pane 164 to be positioned above and then lowered into the glass-retaining recess in the bottom extrusion 166. An L-shaped flange 193 extends above the U-shaped section 188, including a vertical leg 194 and an inwardly facing horizontal leg 195. An end of the horizontal leg 195 includes a recess for supporting a wiper 196 for slidably engaging a side of the vertical down flange 137 on the ceiling channel 51. The second end section 187 includes an up flange 197 and a pair of short protrusions 198 and 199 positioned outboard of the up flange 197. A T-shaped structural side extrusion 200 includes a lower section 201 constructed to abut the up flange 197, with its lower tip 202 engaging the space defined between the base of the up flange 197 and the inner short protrusion 198. A screw 203 extends through a hole in the lower section 201 and threadably into the up flange 197. A hook 204 also engages an upper end of the up flange 197 to further secure the side extrusion 200 to the up flange 197. The inner arm 205 of the T-shaped side extrusion 200 includes a wiper 206 that slidingly engages a side of the vertical down flange 138 in opposition to the other wiper 196. The outer arm 205A of the T-shaped side extrusion 200 includes a detent bump 207. A trim piece 208 includes a flat panel 209, and further includes a bottom hook 210 for frictionally releasably engaging the outer protrusion 199 and a top resilient hook 211 for frictionally releasably engaging the detent bump 207. The flat panel 209 includes a rectilinear ridge 212 near its top that matches a similar rectilinear ridge 213 on the vertical flange 194 of the L-shaped flange 193 on the top frame extrusion 165. When assembled, the top extrusion slidably engages the ceiling channel 51, thus allowing for variations in the height of the building ceiling.

Side frame extrusions 167 (FIG. 25) each include a main side extrusion 214, an opposing rear face extrusion 215, and a glass captor 216. The main side extrusion 214 includes an L-shaped leg 216' with an inner flange 217 shaped to abut the flange 119 on the G-post 115 of the transom subframe 47 and an outer flange 220 that extends toward the front face 184 of the window construction 46. A short section 221 extends from L-shaped leg 216', and includes a notch on an outboard side for supporting a glass wiper 222. A second L-shaped leg 223 extends from the leg 216'. The second L-shaped leg 223 includes a first flange 224 that extends perpendicularly to the outer flange 220, and a second flange 225 that extends toward the front face 184. A detent bump 226 is formed on an outboard end of the second flange 225, and a second bump 227 is formed on the outer flange 220 adjacent the location where the second L-shaped leg 223 joins to the first L-shaped leg 216'. The glass captor 216 is T-shaped and includes an inwardly extending flange 228 and a face-adjacent flange 229 that extends flush to and parallel the front face 184 of the window construction 50. The inwardly extending flange 228 includes a hook 230 at its end, and an elbow 231 at an intermediate location. A notch is formed in one arm 233 of the T-shaped glass captor 216, and a glass wiper 234 is positioned in the notch. When the glass captor 216 is installed, the hook 230 engages the detent bump 227 and the elbow 231 engages the other detent bump 226, causing the glass wiper 234 to engage the glass pane 164, biasing the glass pane 164 against the other glass wiper 222.

Figure 19:
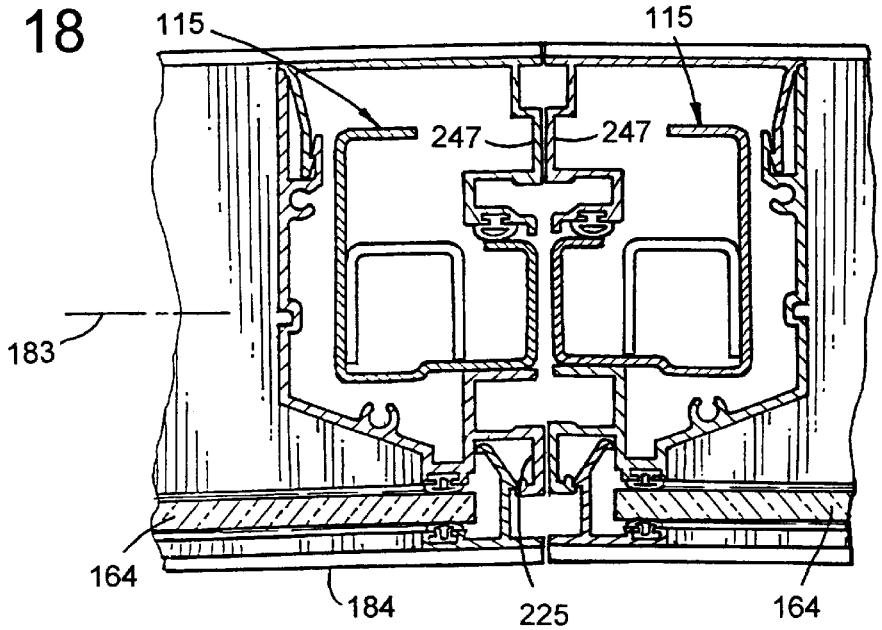
FIG. 19 is a cross-sectional view taken along the line XIX—XIX in FIG. 18.
Figure 24:
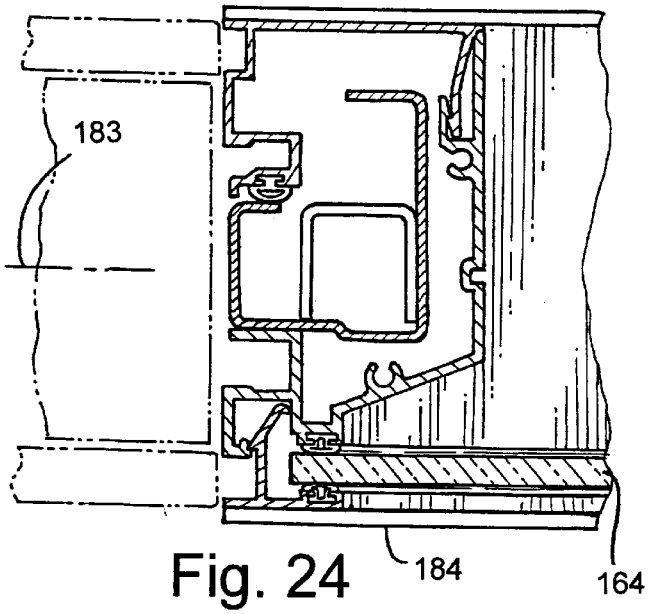
FIG. 24 is a cross-sectional view taken along the line XXIV—XXIV in FIG. 18.
Figure 26:
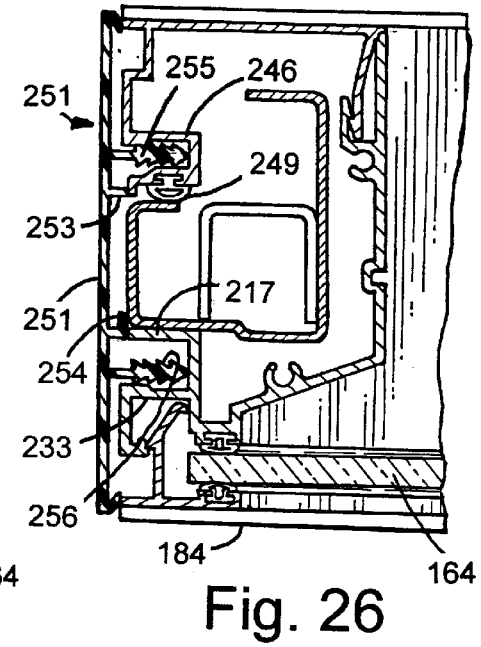
FIG. 26 is a cross-sectional view similar to that shown in FIG. 25, but with the outer side edge of the window frame being covered with a trim cover so that the outer side edge can be used in a visible end to a wall.

The main side extrusion 214 further includes an angled wall section 235, and a fore-aft wall section 236. A pair of screw-receiving boss flanges 237 and 238 are formed on inside surfaces of the angled wall section 235 and the fore-aft wall section 236, respectively. A highlight-line feature 239 is formed in fore-aft wall section 236 at a location space from the corner formed by the juncture of wall sections 235 and 236. An L-flange 240 extends from the boss flange 238, and extends parallel the end section 241 of the fore-aft wall section 236. The L-flange 240 includes a detent ridge 242. The rear face extrusion 215 includes a leg 243 shaped to fit between the L-flange 240 and the end section 241, and includes an enlarged section 244 shaped to frictionally engage the detent ridge 242. A flat panel 245 extends generally perpendicularly to the leg 243, and an S-shaped leg 246 extends from an edge of flat panel 245 inwardly toward the G-post 115. The innermost end 248 of the S-shaped leg 246 includes a notch supporting a wiper 249 for abuttingly engaging the inner flange 117 of the G-post 115. The S-shaped leg 246 also includes an intermediate section 247. When the rear face extrusion 215 is attached to the main side extrusion 214, the wiper 249 and inner flange 217 engage opposing sides of the G-post 115, thus holding the window construction 50 in place on the transom subframe 47, as shown in FIG. 24. Where there is a second window construction 50 adjacent the first window construction 50 (see FIG. 1 and the right side of FIG. 18), the intermediate sections 247 on the S-shaped legs 246 abut and also the outer flanges 225 of the second L-shaped leg 223 abut (FIG. 19), helping align the two adjacent window constructions 50. When there are transom covers 48 positioned in an adjacent position to the window construction 50, the window panes 164 generally align flush with the transom cover 48 on the front face of the overhead system 45 (FIG. 24). When the edge 250 of the window construction 50 is not positioned adjacent anything and the edge 250 remains open and visible, an edge cover 251 (FIG. 26) is attached. The edge cover 251 includes a flat panel 252. A pair of standoff flanges 253 and 254 extend from a back of the flat panel 252 and extend into abutment with the flange 118 of the G-post 115 and with the S-shaped leg 246. A pair of "Christmas tree" connector flanges 255 and 256 extend into frictional engagement with the L-shaped leg 223 and with the S-shaped leg 246, to retain the edge cover 251 to the glass window construction 50.

Figure 20A:
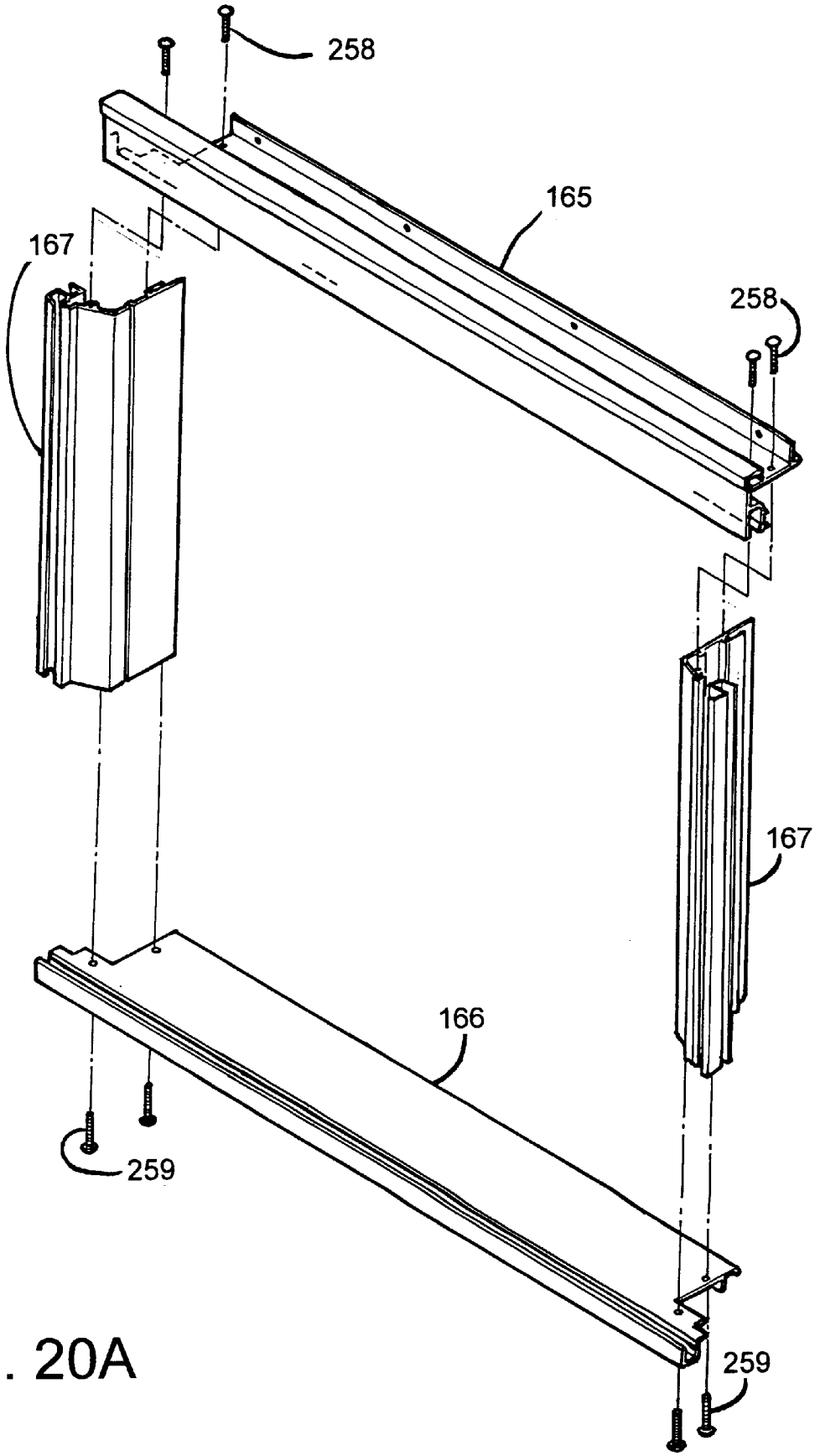
FIG. 20A is an exploded perspective view of the extrusions forming the window frame including the glass pane.
Figure 20B:
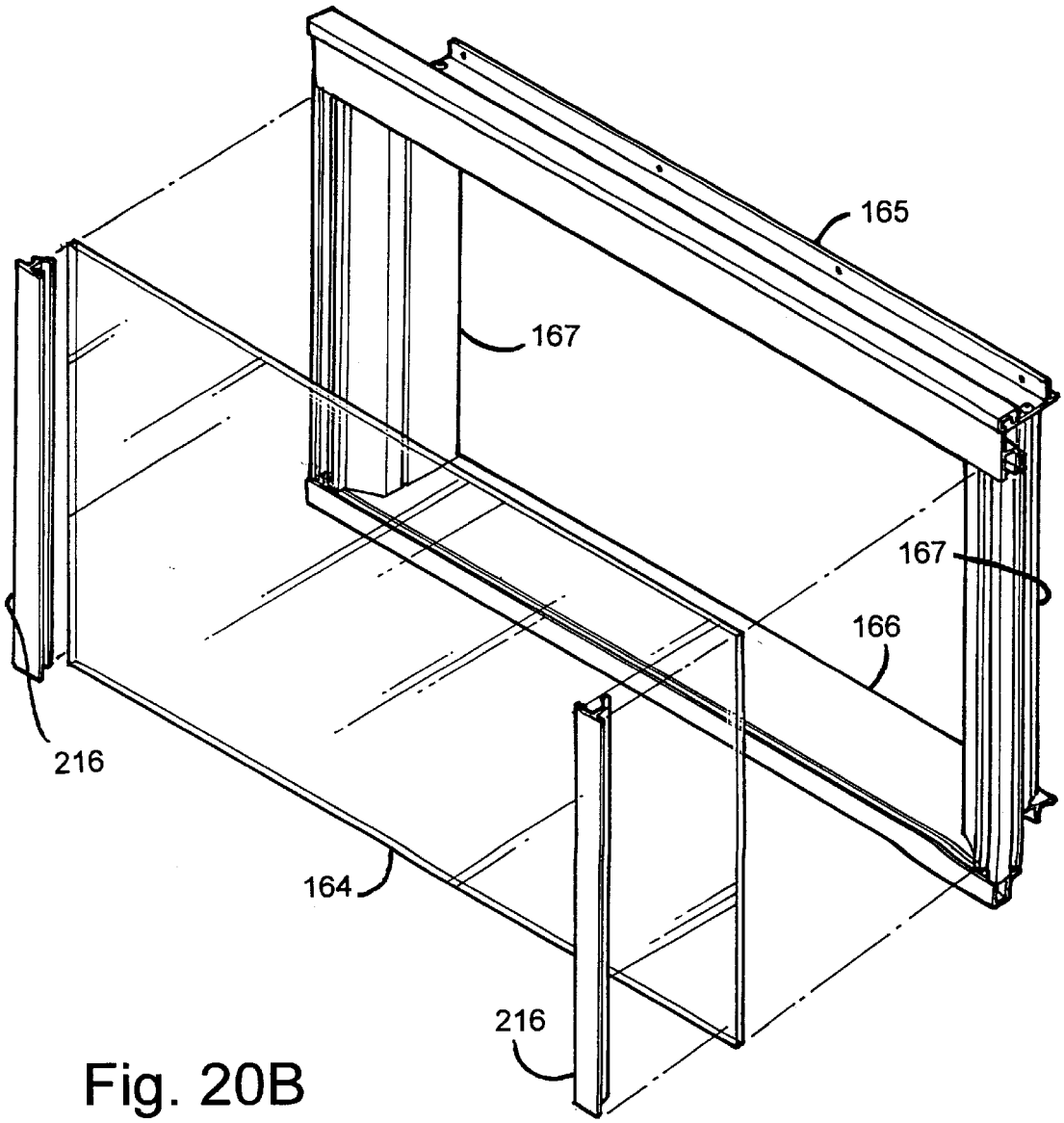
FIG. 20B is a perspective view of the extrusion forming the window frame assembly, with the glass pane and the glass captors exploded away.
Figure 22:
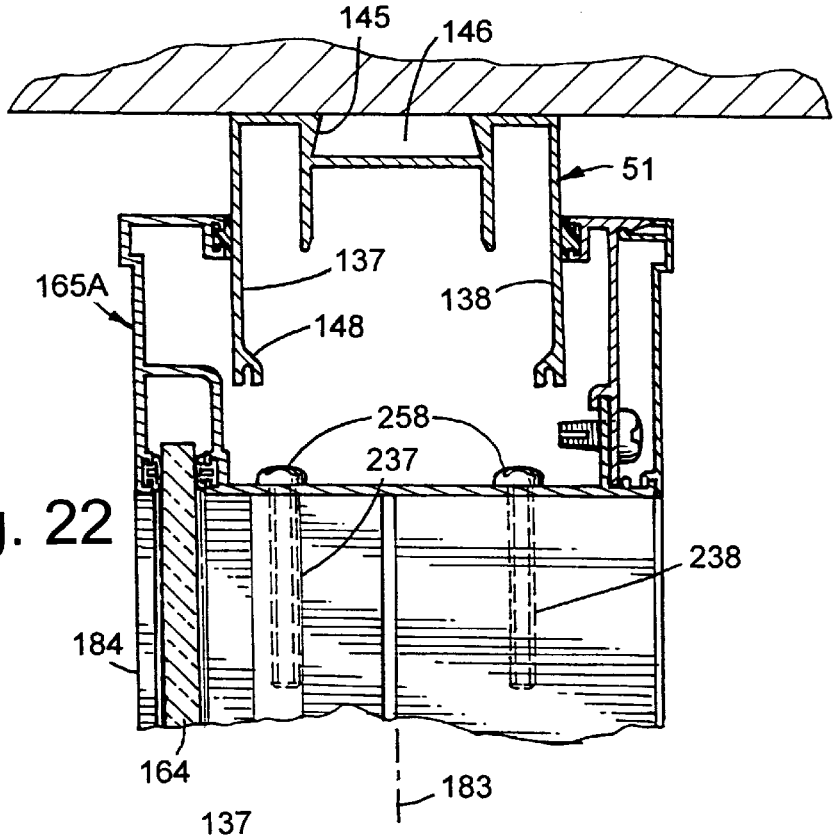
FIG. 22 is a cross-sectional view taken along the line XXII—XXII in FIG. 18.
Figure 23:
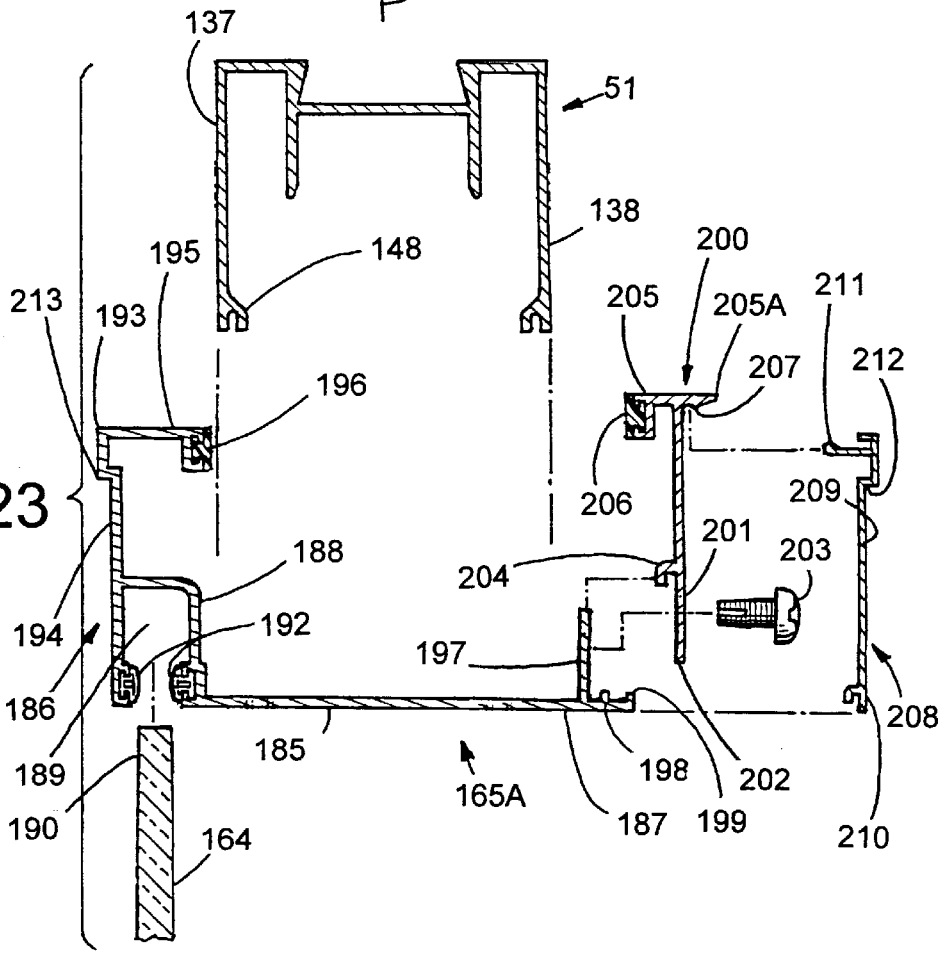
FIG. 23 is an exploded view of FIG. 22.
Figure 25:
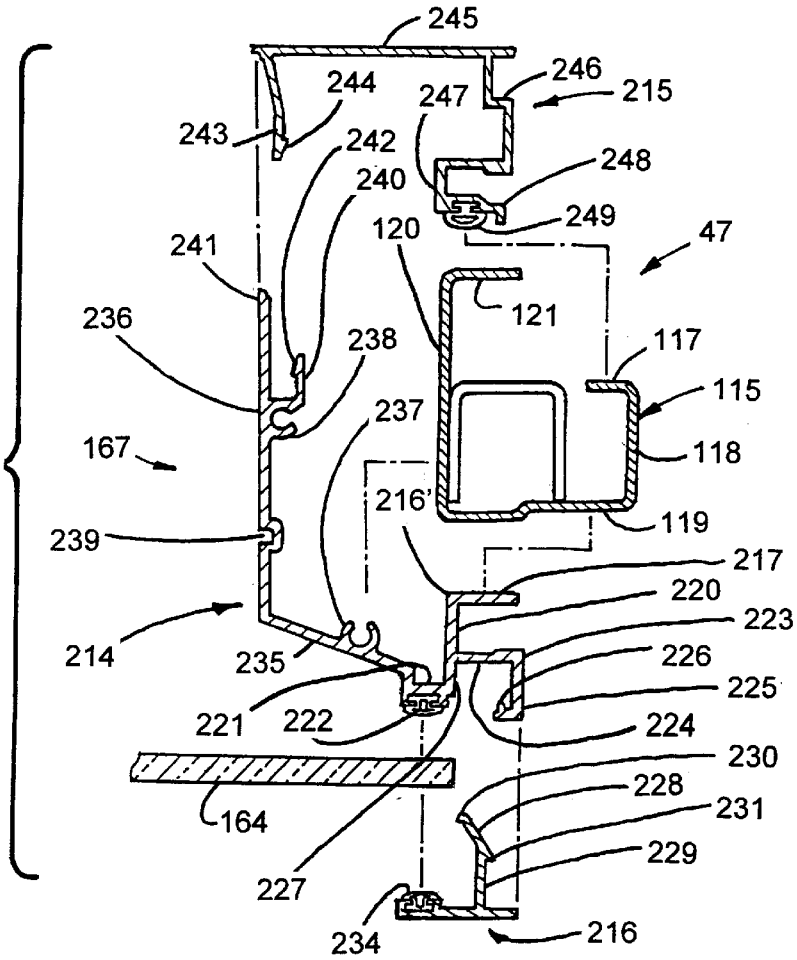
FIG. 25 is an exploded view of FIG. 24.
Figure 27:
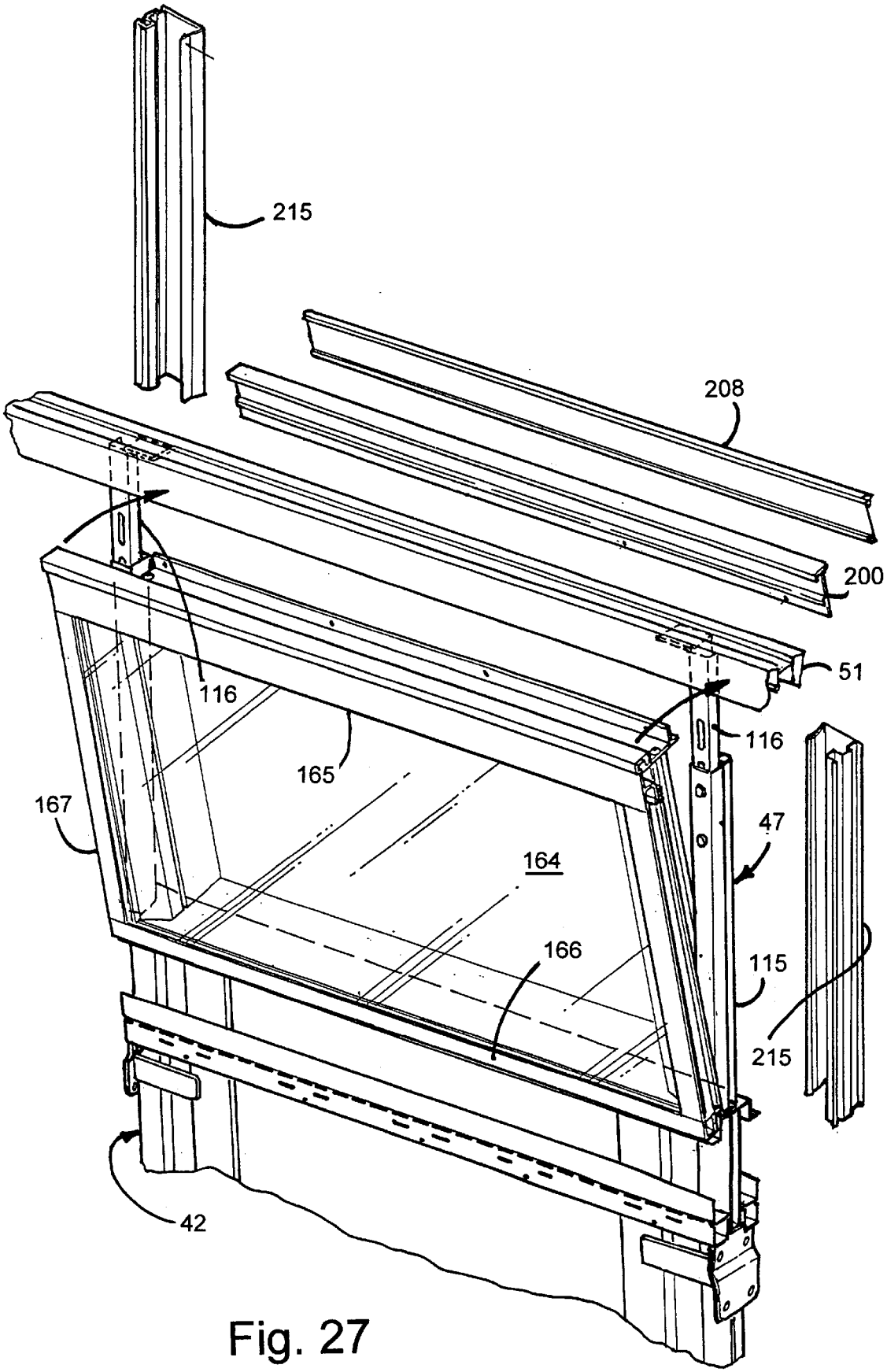
FIG. 27 is a perspective view showing the method of assembly of the glass-supporting transom construction to a base partition panel and between the ceiling channel and a top of the structural expressway construction of the base partition panel.
Figure 27A:
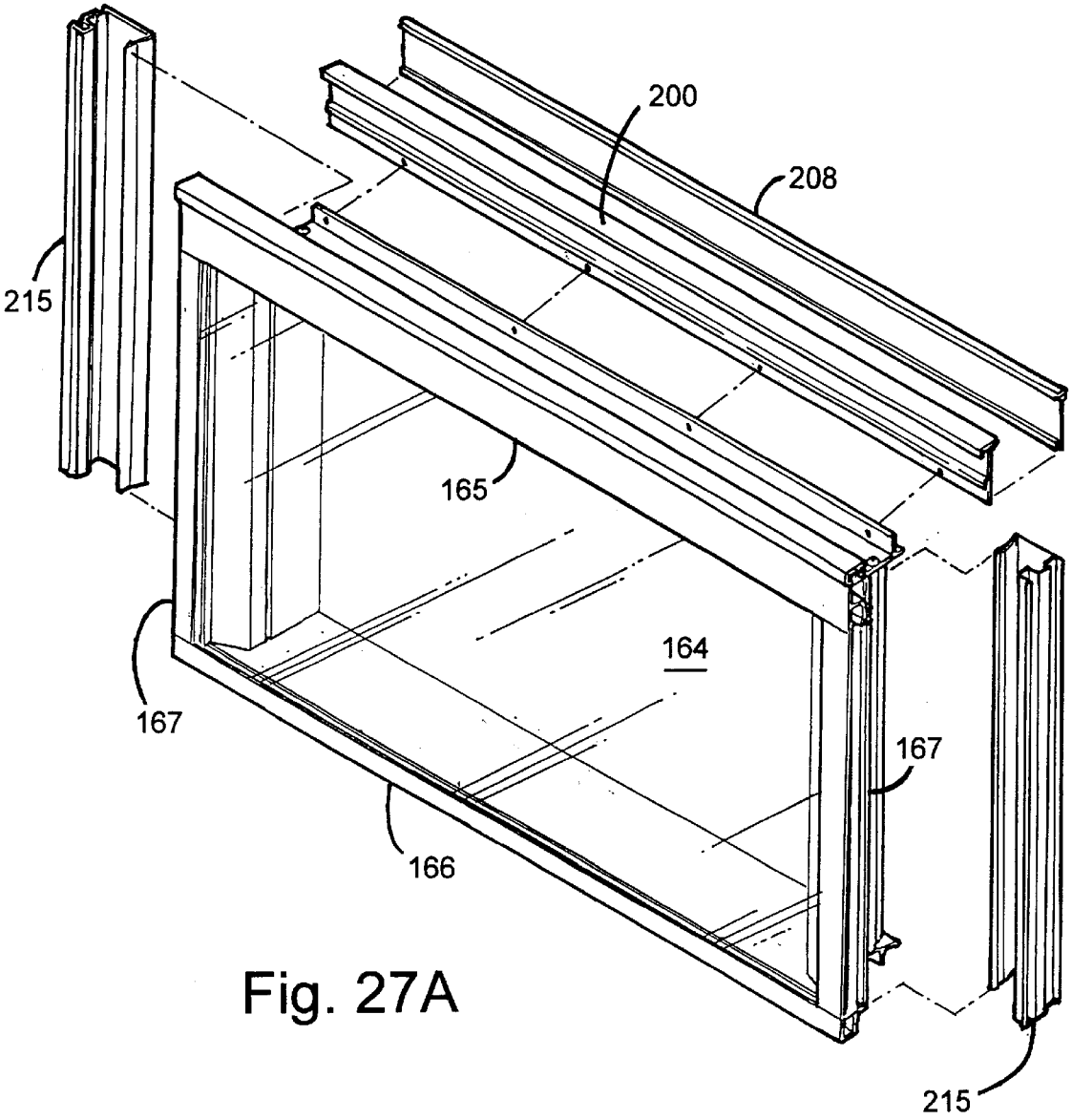
FIG. 27A is a perspective view of the window frame assembly including the glass pane, the assembly being ready for positioning over a base partition panel against transom subframes, the rear components that attach from a rear side against a back of the transom subframes being exploded away.
Figure 28:
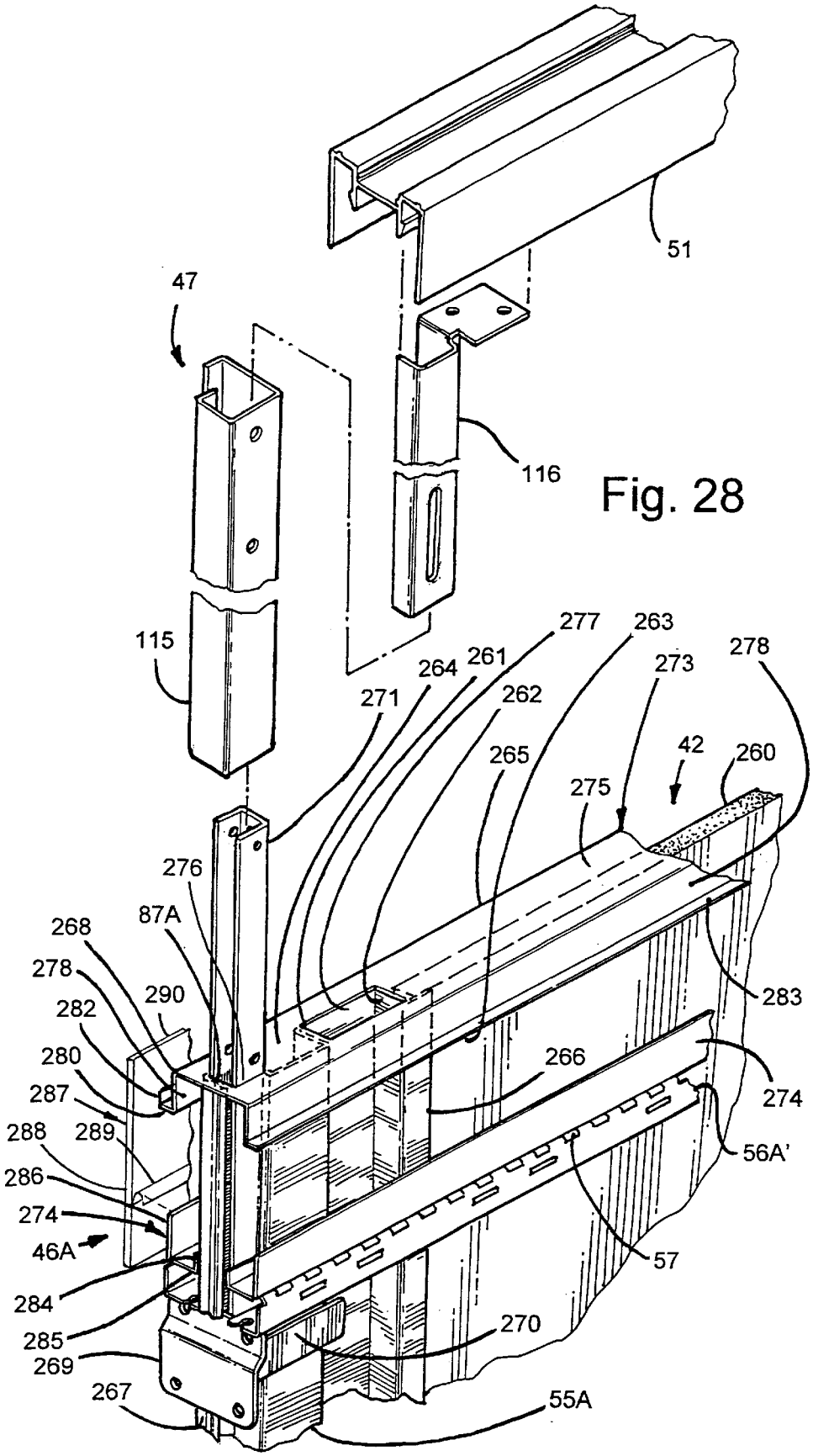
FIG. 28 is an exploded perspective view of the structural expressway construction, similar to that shown in FIGS. 4 and 7, but including structure for attachment to a sound-deadening partition panel as shown in FIG. 1.
Figure 29:
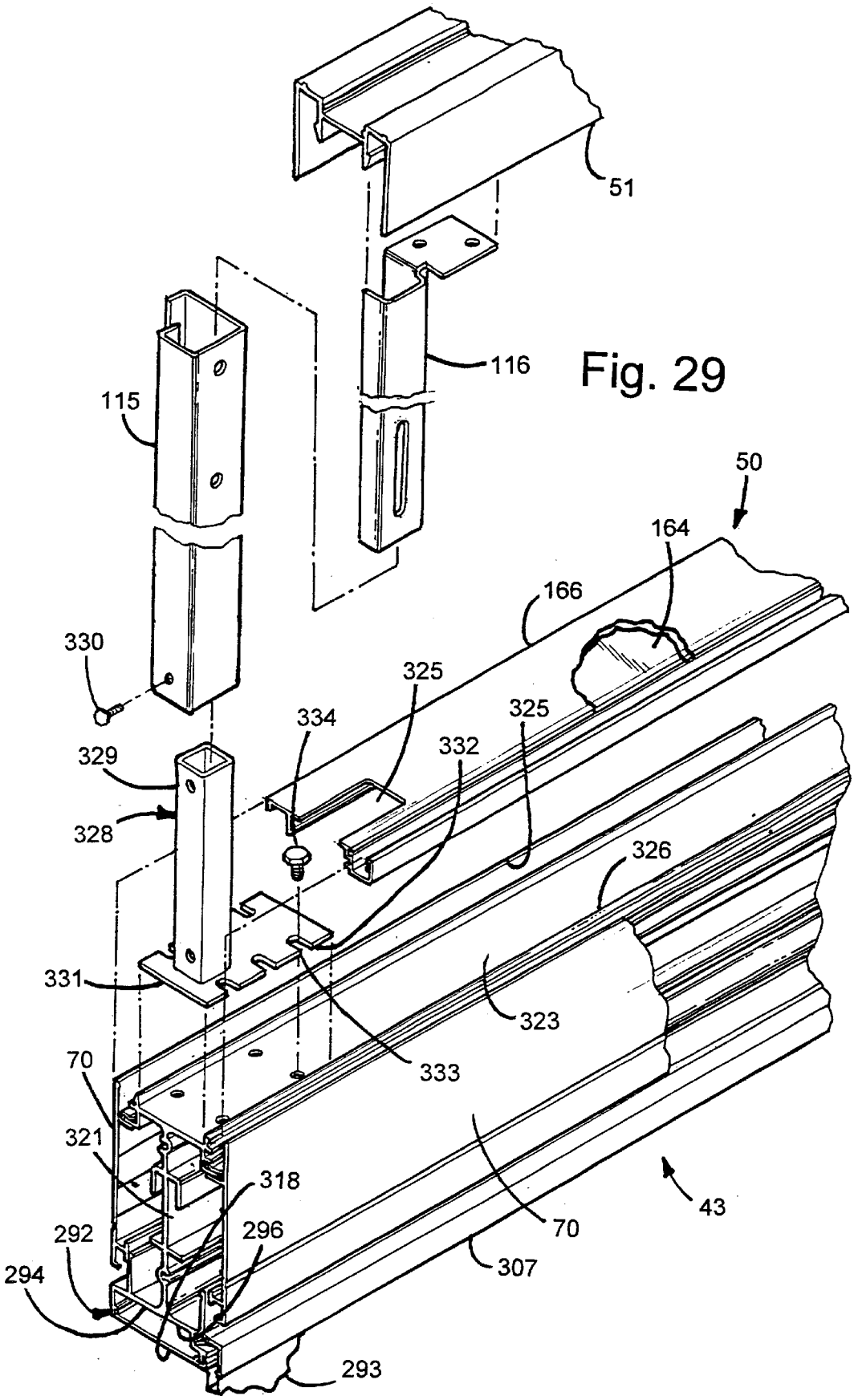
FIG. 29 is an exploded perspective view showing a structural expressway construction for a glass-supporting base panel, and the transom subframe attachment associated therewith.

The extrusions 165–167 of window construction 50 (FIG. 20) are screwed together ahead of their installation, such as at the job site on the floor surface adjacent the partition panel 41. Screws 258 are extended through holes in the top extrusion 165 and threadably into the boss flanges 237 and 238 (FIG. 22, and also see FIGS. 20 and 25). Similarly, screws 259 (FIG. 20) are extended through holes in the bottom extrusion 166 and threadably into the boss flanges 237 and 238 (FIGS. 20 and 25). The glass pane 164 is inserted into the assembled extrusions 165–167 preferably on the floor surface, and the additional extrusions and covers described above are assembled to the extrusions 165–167 to provide a complete assembly, except for the rear face extrusions 215. The rear face extrusions 215 are assembled to the window construction 50 after the window construction 50 is positioned in the transom area between the associated transom subframes 47. Specifically, the window construction 50 is installed by inserting its upper edge into mating sliding engagement with the ceiling channel 51 (FIGS. 22 and 27). The window construction 50 is slid upwardly until its bottom edge can be positioned on the expressway construction 46, and then the window construction 50 is lowered until it matingly engages the top of the expressway construction 46. Thereafter, the rear face extrusions 215 are assembled to the window construction 50 and any additional screws or connectors are attached as desired. The number of additional screws and other connectors depend upon the particular design criteria of the manufacturer and/or government regulation and/or purchaser. The secondary covers and trim pieces are attached whenever the installer prefers. It is noted that the G-post 115 can be inverted so that the recess for receiving the window assembly 50 can be received from an opposite face of the wall system 40.

The sound-absorbing partition panel 42 (FIG. 28) and its structural expressway construction 46A has a construction related to the internally open partition panel 41 (FIGS. 1–3) and the structural expressway construction 46. The sound-absorbing partition panel 42 is described in detail in the coassigned, copending application Ser. No. 09/038,371 previously referred to above. Nonetheless, the sound-absorbing partition panel 42 is described in sufficient detail below to provide an understanding of the present invention.

The sound-absorbing partition panel 42 includes uprights 55A and selected horizontal frame members 56A'. The horizontal frame members 56A' are similar to the horizontal frame members 56A–56F in that the frame members 56A' include faces with at least one horizontal row of slots 57 therein. However, sound-absorbing partition panel 42 includes a sound-absorbing sheet 260 such as a drywall or gypsum panel, or other sheet of sound-absorbing material. Optionally, this sheet 260 is also fire resistant (which drywall is). The sheet 260 is positioned between opposing ones of the horizontal frame member 56A', and extends horizontally/longitudinally within the partition panel 42 between the uprights 55A. The uprights 55A include multiple bends or corrugations, and include an S-shaped section 261 that defines a first U-shaped channel 262 facing toward a first face 263 of the partition panel 42, and a second U-shaped channel 264 facing toward a second face 265 of the partition panel 42. The channels 262 and 264 define vertical raceways for routing wiring and cabling. An inboard flange 266 supports an edge of the sheet 260. An outboard flange 267 extends to a vertical side edge 268 of the partition panel 42. A vertical abutment-type edge connector 269 is attached at the vertical side edge 268, and support straps 270 extend inwardly and are attached to opposing sides of the upright 55A. A C-channel connector 271 extends upwardly from a top of the upright 55A. The C-channel connector 271 is configured to matingly engage the G-post 115 of the transom subframe 47 described below. Notably, the C-channel connector 271 can be extended vertically if desired for the following reason. The C-channel connector 271 is configured to fit upwardly into the pocket 87A of transom construction 46 (i.e. the pocket 87A that was described above as being engaged by the connector 87 adjacent the vertical side edge of the partition panel 41). If the C-channel connector 271 is made long enough to extend above the expressway construction 46, it can provide for attachment of both the expressway construction 46, as well as provide for connection to the G-post 115.

However, the illustrated sound-absorbing partition panel 42 has an integrally formed expressway 46A intended to compliment the sound-absorbing nature of the partition panel 42 (i.e. The separate expressway construction 46 is not normally attached to a top of the partition panel 42, because the partition panel 42 has the integrally formed expressway 46A). The integrally formed expressway construction 46A includes a hat-shaped top channel 273 and a pair of bottom channels 274. The top channel 273 includes a flat transverse center web 275 with an aperture 276 to receive the C-channel connector 271, and another aperture 277 aligned with one or both of the U-shaped channels 262 and 264 for allowing wiring and cabling to be routed from the channels 262 and 264 out through aperture 277 and back into the other of the channels 262 and 264, thus allowing wiring to be routed from side-to-side of the partition panel 42. The top channel 273 further includes down flanges 278 on each side, outward flanges 280, and up flanges 282 and 283. The bottom channels 274 are positioned on opposite sides of the uprights 55A, and each include an inner attachment flange 284 for attachment to the uprights 55A, an outward flange 285, and an up flange 286. The up flanges 282 and 286 form attachment features that are engageable by the bottom hook connectors or down flanges 154 on the transom covers 54. The outward flange 285 of the bottom channel 274 rests on a horizontal frame member 56A' that forms a horizontal row of slots 57. An expressway cover 287 includes a flat panel 288 and a U-shaped downwardly facing connector 289 shaped to frictionally engage the bottom up flange 286, the connector 289 being configured to bias an upper portion 290 of the cover 287 against the top up flange 282, so that the cover 287 closely engages and covers a side of the integral expressway construction 46A. The G-post 115 attaches to an upper portion of the C-channel connector 271 as previously described (compare FIGS. 13, 14, and 19), and further connects to the ceiling channel 51 as previously described (see FIGS. 14 and 15). The transom covers 48 and the window constructions 50 attach atop the partition panel 42 with integral expressway construction 46A in an identical or very similar manner to that described above, and therefore that discussion does not need to be repeated.

Figure 30:
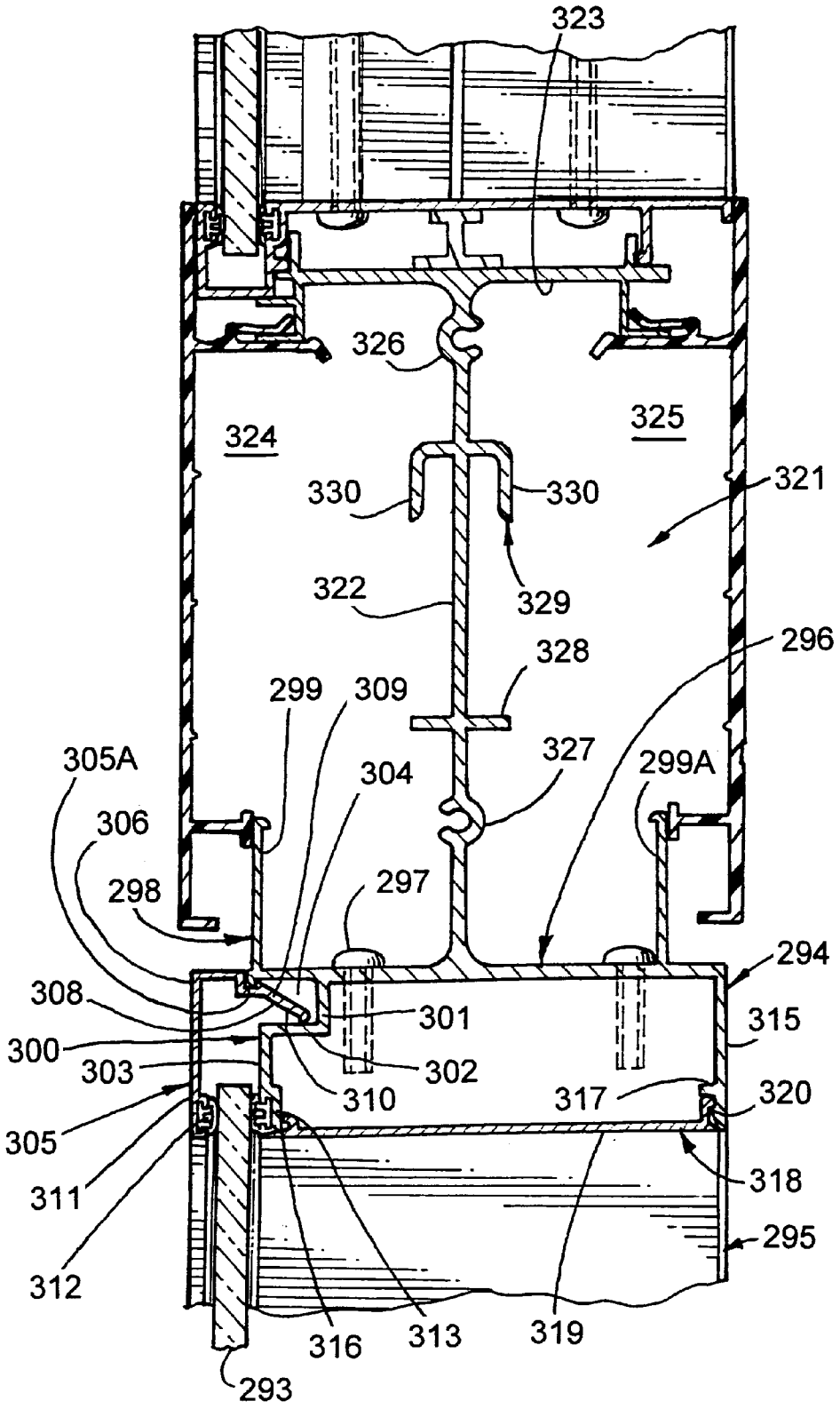
FIG. 30 is a cross-sectional view of the structural expressway construction shown in FIG. 29.

The glass-supporting base partition panel 43 (FIG. 29) is described in detail in the coassigned, copending application Ser. No. 09/037,476 previously referred to above. Nonetheless, the glass-supporting base partition panel 43 is described below in sufficient detail to provide an understanding of the present invention. The glass-supporting partition panel 43 include a perimeter "window" frame 292 extending from the building floor to about 84 inches and configured to support a bottom glass pane 293. The frame 292 includes, among other components, a top extrusion 294 and side extrusions 295 (FIG. 30). The top extrusion 294 for partition panel 43 includes a flat panel 296 attached by screws 297 to side extrusions 295, in an assembly not unlike the attachment of top frame extrusion 165 to side frame extrusion 167 in window construction 50. A configured end section 298 is formed on one end of the flat panel 296, and includes an up flange 299. A down flange 300 extends from flat panel 296, and includes a vertical first flange 301 spaced from the end of the flat panel 296, a horizontal second flange 302 that extends outwardly, and a vertical third flange 303 that extends downwardly. The first and second flanges 301 and 302 form a recess 304. A detent 305A is formed under the end of the flat panel 296 adjacent the recess 304. An L-shaped glass captor 305 includes an outer leg 306 that extends flush with the front face 307 of the partition panel 43, and an inwardly extending leg 308. The inwardly extending leg 308 includes an elbow 309 that frictionally engages the detent 305, and further includes an arm 310 that extends into the recess 304. The arm 310 presses against the second flange 302 and, in combination with elbow 309, biases the opposite end 311 of the outer leg 306 toward the third flange 303. The third flange 303 and the opposite end 311 include opposing notches that support glass wipers 312 and 313, respectively, for engaging the bottom glass pane 293. A down flange 315 extends downwardly from the "rear" of flat panel 296. The lower ends of the third flange 303 and down flange 315 include opposing detent ridges 316 and 317. A trim piece 318 includes a flat panel 319, and further includes a pair of up hooks 320 for engaging the detent ridges 316 and 317 to retain the trim piece 318 in place on an inboard/bottom side of the top extrusion 294 of the glass-supporting partition panel 43. A pair of up flanges 299 and 299A extend above the top extrusion 294 of partition panel 43.

The top extrusion 294 includes an I-beam-like section 321 including a central vertical web 322, and a top transverse web 323, the bottom transverse web of the I-beam being formed by the flat panel 296. The I-beam-like section 321 defines opposing wireway cavities 324 and 325. The I-beam-like section 321 aligns with the structural expressway construction 46 and/or 46A, and the wireway cavities 324 and 325 allow continuous routing of wiring and cables along the wall system 40, regardless of whether partition panels 41, 42, or 43 are in that particular portion of the wall system 40. The central vertical web 322 includes top and bottom screw-receiving boss flanges 326 and 327 configured to receive a screw to attach a component to an end of the I-beam-like section 321, such as an end cover or the like, and further includes laterally extending horizontal attachment flanges 328 and L-shaped attachment flanges 329 with down legs 330. The flanges 328 and 329 are configured to engage and support a bracket such as the J-box bracket 89 described earlier, with the top and bottom attachment flanges 94 and 95 being attached to the flanges 328 and 330. This positions the center flange 91 of the J-box bracket 89 on the I-beam-like section 321, so that work accessories such as junction boxes, lighting fixtures, or work tool rails can be attached thereto.

Figure 31:
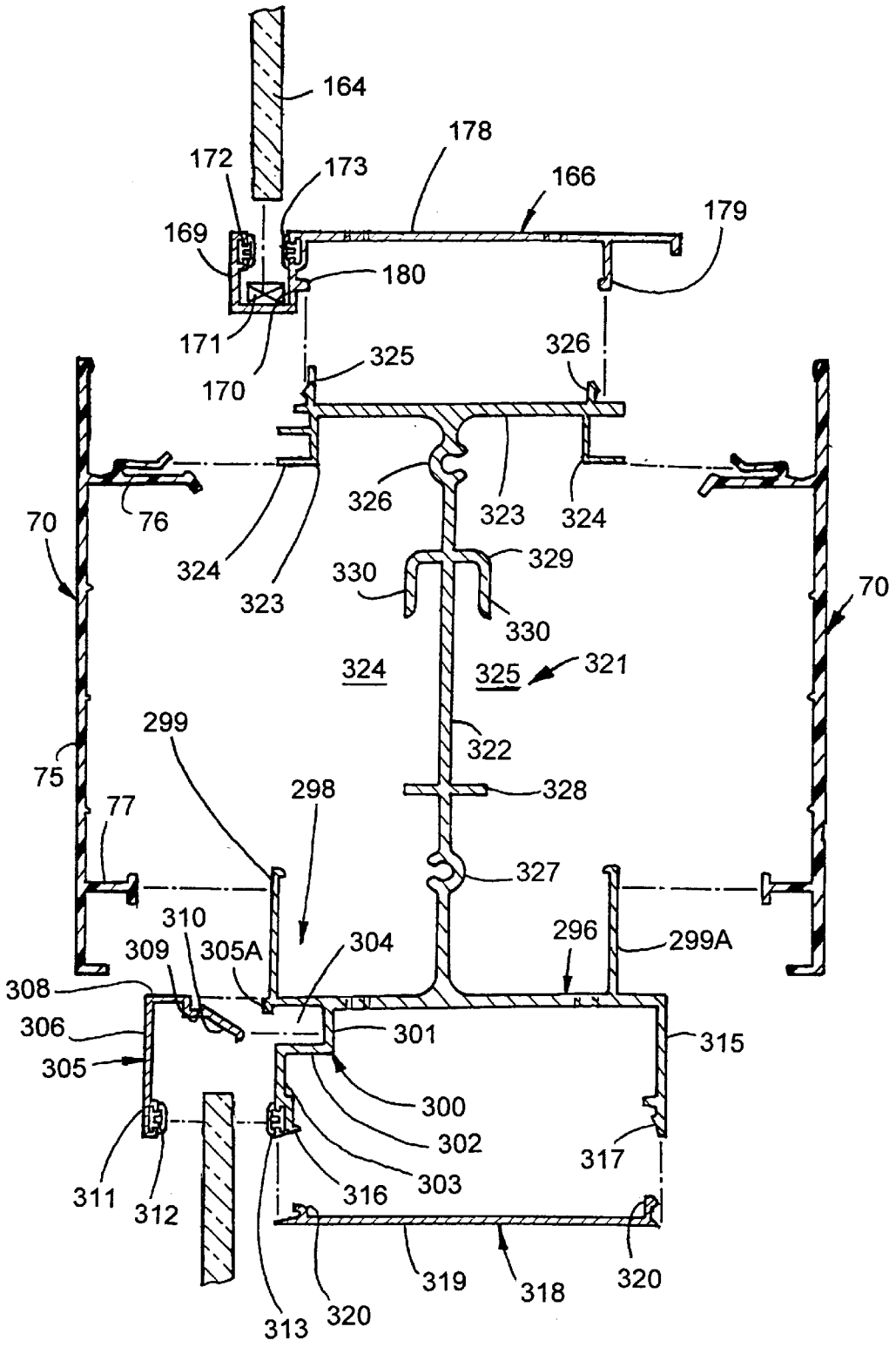
FIG. 31 is an exploded view of the structural expressway construction shown in FIG. 30.

Inverted L-shaped flanges 322 and 323 (FIG. 31) are formed on opposite ends of the top transverse web 323. The L-shaped flanges 322 adjacent the "glass side" or front face 307 includes a laterally extending leg 324. The expressway cover 70, previously described, includes an upper clip 76 configured to releasably frictionally engage the leg 324, with the foot 77 biased against and engaging the up flanges 299 and 299A and with the flat panel 75 covering a side of the I-beam-like section 321. The L-shaped flange 323 is similarly configured to support an expressway cover 70 on the opposite side of the I-beam-like section 321. The top transverse web 323 of the I-beam-like section 321 is configured to mateably engage the bottom extrusion 166 of the window construction 50. Specifically, a pair of protrusions 325 and 326 extend above the web 323 and are adapted to frictionally engage the hooked arm 179 and detent 180 on the bottom extrusion 166.

A subframe connector 328 (FIG. 29) includes a tube section 329 configured to mateably engage the G-post 115 of the transom subframe 47 and to be attached with screws 330. A flat foot plate 331 is welded to the bottom of tube section 329. The foot plate 331 is rectangular and is configured to fit mateably into a top of the top web 323 between up protrusions 325 and 326. The foot plate 331 includes side edges 332 having notches 333 shaped to receive screws 334 to attach the foot plate 331 to the top web 323. The bottom extrusion 166 of the window construction 50 includes a notch 335 at each end to receive the tube section 329.

Figure 32:
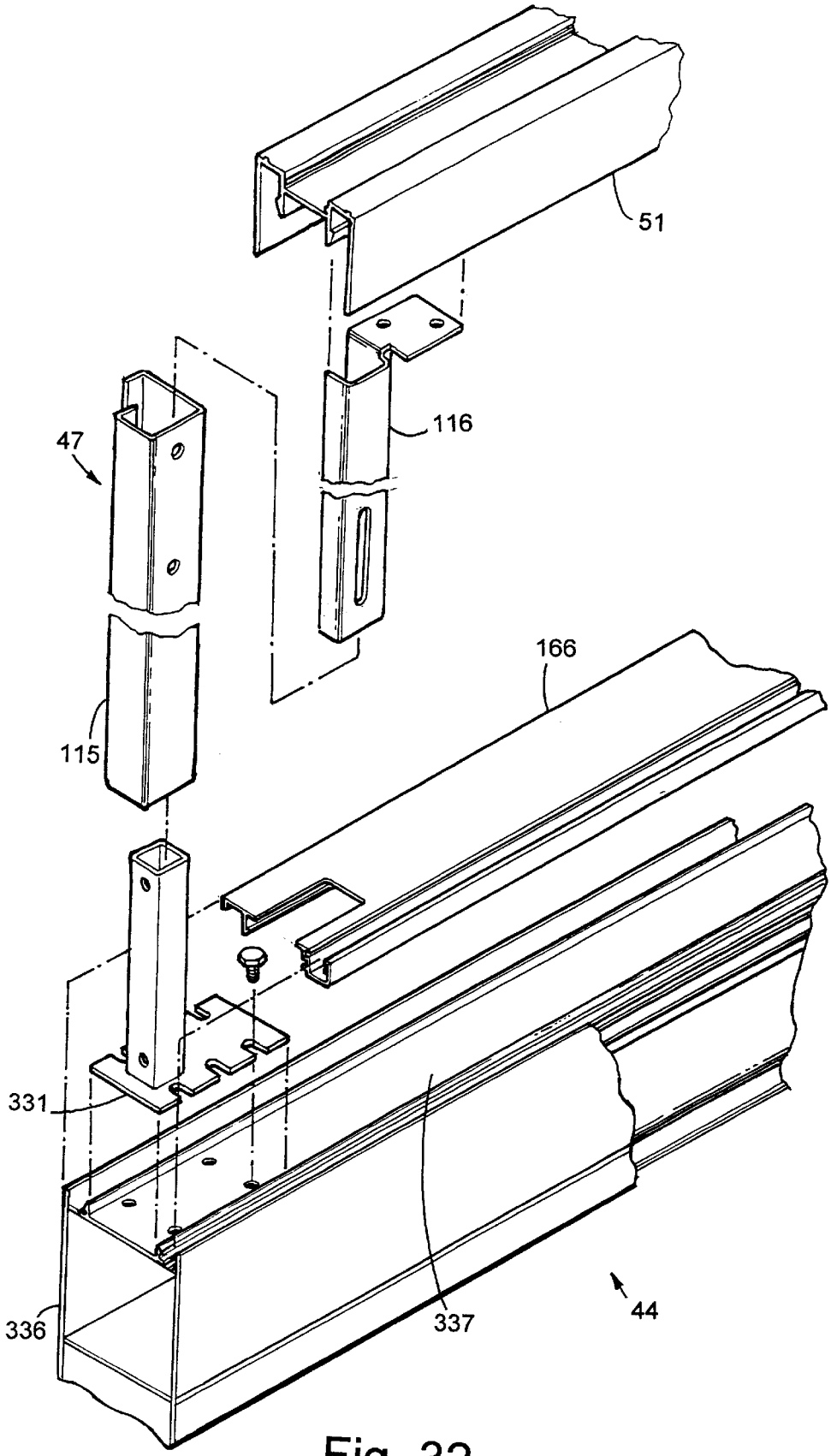
FIG. 32 is an exploded perspective view of a structural expressway construction attached atop a doorway-supporting base panel, and the transom subframe constructed for use therewith.

The doorway-supporting partition panel 44 (FIG. 32) includes a box-shaped top frame member 336 having a top wall section 337 that substantially duplicates the upper edge of the transverse top web 323 of the I-beam-like section 321. The foot plate 331 is welded to G-post 115 and is used to attach the transom subframe 47 to a top of the doorway-supporting partition panel 44. The doorway-supporting partition panel 44 also illustrates that the present overhead system 45 can be used on a generic base partition panel of the wall system 40.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The invention claimed is:

1. A structural wireway construction adapted for attachment atop a base partition panel and adapted to support a transom structure that extends thereabove, the base partition panel including vertical side edges, comprising:

a pair of outwardly facing, elongated wireway troughs;

a torque box bracket attached between the wireway troughs near an end of the wireway troughs for providing torsional strength at the end of the wireway troughs, the torque box bracket and wireway troughs defining a pocket located near but inboard of the end of the wireway troughs, the wireway troughs and the torque box bracket forming a structural unit capable of supporting loads thereabove; and at least one elongated edge connector having a lower end section extending into the pocket and connected to one of the torque box bracket and the troughs, and having an upper end section that extends upwardly and that is adapted for connection to the transom structure, the edge connector being located at the end of the wireway troughs and being configured to structurally support the transom structure at the one vertical side edge.

2. The structural wireway construction defined in claim 1 including a post connector attached to the torque box bracket and extending downwardly therefrom, the post connector being configured to structurally connect the wireway construction to the partition panel.

3. The structural wireway construction defined in claim 2 including a second torque box bracket, one of the first-mentioned and second torque box brackets being positioned at each end of the wireway troughs.

4. The structural wireway construction defined in claim 3 including a second post connector, the first-mentioned and second post connectors being attached at inwardly facing side edges of the first-mentioned and second torque box brackets, respectively, the first-mentioned and second post connectors both adapted to be spaced inboard of the vertical side edges of the partition panel.

5. The structural wireway construction defined in claim 4 including an elongated stiffener brace that extends parallel the wireway troughs and that is structurally interconnected to the wireway troughs at multiple locations along the wireway troughs.

6. The structural wireway construction defined in claim 2 including a transom subframe attached to the edge connector and supported on the pair of wireway troughs generally above the torque box, the transom subframe being adjustably extendable and being constructed for connection to a building ceiling.

7. The structural wireway construction defined in claim 6 including a decorative skin releasably attached to one of the wireway troughs for covering a space above the wireway troughs up to the building ceiling.

8. The structural wireway construction defined in claim 6 including a window assembly configured for mating attachment to the transom subframe and to a top of the wireway troughs and configured to fill a space above the wireway troughs up to the building ceiling.

9. The structural wireway construction defined in claim 1 wherein the wireway troughs are each C-shaped with upper and lower flanges defining a space therebetween, and including a cover snap attached to at least one of the upper and lower flanges for covering the space.

10. The structural wireway construction defined in claim 1 including a support bracket and a work tool rail attached to one of the wireway troughs for supporting accessories thereon that facilitate performing work-related tasks.

11. The structural wireway construction defined in claim 1 including a light attached to one of the wireway troughs.

12. A wall system for subdividing a building space including a floor and a ceiling, comprising:

a base partition panel having a partition frame;

a ceiling channel configured for attachment to the ceiling and having a down flange;

an adjustably extendable transom subframe having a bottom end attached to the partition frame and a top end attached to the ceiling channel, one of the transom subframe and the partition frame including an upwardly extending flange proximate a face of the base partition panel near a top edge of the partition frame; and a transom cover shaped to cover a space between the top edge of the partition frame and the ceiling, the transom cover including a hooked lower connector for engaging the upwardly extending flange, and including an upper edge with an upper connector configured to engage the down flange on the ceiling channel.

13. The wall system defined in claim 12 wherein the upper connector includes a movable attachment flange that is movable between a first position facilitating installation or removal of the transom cover, and an adjusted second position where the attachment flange is positioned to retain the upper edge of the transom cover to the ceiling channel.

14. The wall system defined in claim 13 wherein the attachment flange, when in the second position, is located adjacent the down flange, and includes a screw hole facilitating screw attachment to the down flange.

15. The wall system defined in claim 14 wherein the attachment bracket includes an elongated flexible arm operably supporting the attachment flange.

16. The wall system defined in claim 15 wherein the flexible arm has a flat cross section and extends horizontally so that the flexible arm is bendable to move the attachment flange vertically.

17. The wall system defined in claim 12 wherein the upper connector includes a spring clip for frictionally engaging the down flange on the ceiling channel.

18. The wall system defined in claim 12 including a trim piece configured for attachment to the ceiling channel at a location adjacent the ceiling to cover a gap above the cover panel up to the ceiling.

19. The wall system defined in claim 18 wherein the ceiling channel defines a groove, and wherein the trim piece includes a connector shaped to frictionally engage the groove to secure the trim piece in position.

20. The wall system defined in claim 12 wherein the base partition panel includes a structural expressway construction attached atop the base partition panel, the structural expressway construction including the upwardly extending flange for engaging the lower connector on the transom cover, the transom cover being slidably along the upwardly extending flange for horizontal adjustment.

21. A wall system for subdividing a building space including a floor and a ceiling, comprising:

a base partition panel having a frame including a frame member defining a top surface;

a ceiling channel configured for attachment to the ceiling;

an adjustably extendable transom subframe having a bottom end attached to the frame member and a top end attached to the ceiling channel; and a window construction shaped to fit within a space between a top edge of the frame and the ceiling, the window construction including a window frame with a lower section configured to mateably engage the top surface, side sections shaped to mateably slidably engage the subframe from a face of the wall system, and a top section shaped to matingly engage the ceiling channel.

22. The wall system defined in claim 21 wherein the transom subframe defines a rectangular marginal recess for receiving the side sections from a front of the wall system to a predetermined depth.

23. The wall system defined in claim 21 wherein the base partition panel includes a non-planar top surface, and wherein the lower section matingly interlockingly engages the non-planar top surface.

24. The wall system defined in claim 21 wherein the side sections each include a main extrusion for mateably engaging the transom subframes, and further include a rear mounted extrusion attachable to the main extrusion for capturing the transom subframe therebetween.

25. The wall system defined in claim 21 wherein the top section includes a main extrusion and a rear mounted extrusion, each including flanges that abut opposing sides of the ceiling channel.

26. The wall system defined in claim 21 wherein the base partition panel defines a longitudinal/vertical central plane, and wherein the window construction includes a single glass pane mounted thereon in a location spaced forwardly and offset from the longitudinal/vertical central plane of the base partition panel.

27. The wall system defined in claim 21 wherein the transom subframes define a forwardly open marginal recess for receiving the window construction, so that the window construction can be inserted from a front of the base partition panel.

28. A method of closing an overhead space between a partition system and a ceiling, comprising steps of:

providing a base partition panel having vertical side edges and a top edge;

attaching a pair of adjustably extendable transom subframes to the top edge at each of the vertical side edges and to a ceiling channel, the subframes combining with the base partition panel and the ceiling channel to define an overhead space therebetween;

providing a transom cover shaped to cover the overhead space and including connectors configured for attachment to the ceiling channel and the base partition panel;

providing a window assembly shaped to cover the overhead space, the window assembly including a window frame shaped to mateably engage the subframes, the ceiling channel, and the top edge of the base partition panel, and a light-transmitting sheet secured to said window frame; and selecting and then securing one of the transom cover and the window assembly in the overhead space.

29. The method defined in claim 28 wherein the step of selecting includes selecting the transom cover, and further includes releasably engaging a lower connector on the transom cover with the top edge of the base partition panel.

30. The method defined in claim 29 wherein the transom cover includes an upper edge and a movable connector thereon, and including a step of vertically adjusting the movable connector to attach the transom cover to the ceiling channel.

31. The method defined in claim 29 wherein the transom subframes define a recess, and including a step of aligning the window assembly with the recess in the transom subframes.

32. A kit for closing an overhead space between a wall panel system and a ceiling, comprising:

a base partition panel having vertical side edges and a top edge;

a ceiling channel configured for attachment to a ceiling;

a pair of extendable transom subframes having a bottom end configured to attach to the top edge at each of the vertical side edges and a top end configured to attach to a ceiling channel, the subframes when attached to the base panel and the ceiling channel defining an overhead space;

a transom cover shaped to cover the overhead space, the transom cover including connectors configured for attachment to at least one of the subframes, the ceiling channel, and the base panel; and a window assembly shaped to cover the overhead space, the window assembly including a window frame shaped to mateably engage the subframes, the ceiling channel, and the base panel, whereby the transom cover and the window assembly can be selectively used to cover the overhead space.

33. The kit defined in claim 32 wherein at least one of the transom cover and the window assembly have a lower surface configured to mateably engage the top edge.

34. The kit defined in claim 32 wherein the transom cover includes an upper edge having a movable connector attached thereto, the movable connector being adjustable to permit attachment to the ceiling channel.

35. A wall system for subdividing a building space, comprising:

a partition panel having a rigid frame defining vertical side edges and a top edge section, the rigid frame including an upright;

a pair of outwardly facing, elongated wireway troughs attached to the upright and that define horizontal raceways along the top edge section, the wireway troughs being constructed to bear weight and to support work tool accessories; and a bracket having attachment flanges shaped for connection to one of the wireway troughs and having a cantilevered portion extending outwardly from said wireway troughs and including a body defining a connecting portion spaced laterally from the attachment flanges and configured to support an accessory on the one wireway trough.

36. The wall system defined in claim 35 including a pair of bayonet connectors and a pair of torque box brackets located between and attached to the wireway troughs, the torque box brackets each having an attachment face attached to an associated one of the bayonet connectors.

37. The wall system defined in claim 35 including a light fixture attached to the bracket.

38. The wall system defined in claim 35 including an adjustably extendable transom subframe attached to one of the wireway troughs and constructed for connection to a ceiling channel.

39. The wall system defined in claim 36 including a work tool rail for supporting accessories attached to the bracket on one side of the structural expressway construction.

40. A wall system for subdividing a building space, comprising:

a wall partition panel having vertical side edges and a top edge, the wall partition panel including a frame with uprights located near the vertical side edges and including a pair of elongated vertically extending connectors attached to the uprights along the vertical side edges, the vertically extending connectors including an upper end extending above the top edge, the wall partition panel having front and rear faces that define a vertical/longitudinal central plane therebetween; and a pair of telescopically adjustable transom subframes each including a lower elongated frame member attached to the upper end of an associated one of the vertically extending connectors, and an upper telescopingly adjustable frame member with a flange adapted for connection to a ceiling channel, the lower elongated frame member having flanges defining a non-uniform cross section relative to the vertical/longitudinal central plane.

41. The wall system defined in claim 40 wherein the flanges of the lower elongated frame member include a first flange defining an enlarged recess on the front face for receiving a window frame assembly, and include a second flange for abutting the window frame to locate the window frame at a predetermined inserted depth, the first flange being spaced from the vertical/longitudinal central plane and having a dimension greater than the second flange to provide the subframe with improved torsional and tensile strength.

42. The wall system defined in claim 41 wherein the lower elongated frame member has a G-shaped cross section.

43. The wall system defined in claim 40 including a window construction configured for attachment atop the structural expressway construction and between the pair of transom subframes, the window construction including a glass pane located offset and forwardly from the vertical/longitudinal central plane.

44. The wall system defined in claim 40 wherein the wall partition panel includes an upright having an S-shaped section.

45. A wall system for subdividing a building space, comprising:

a base partition panel;

a ceiling channel;

an extendable transom frame configured for attachment between the base partition panel and the ceiling channel; and a transom cover having a top edge section made of a material that can be readily cut at a job site, and a removable top connector attached to the top edge section and configured to be removed and later reattached to the transom cover after cutting off part of the top edge section of the transom cover, the top connector being configured to securely engage one of the ceiling channel and the extendable transom frame to retain the transom cover in a position to cover the transom frame, whereby the transom cover can be cut to a desired size on the job site.

* * * * *